US009506714B1

(12) United States Patent
Eacker et al.

(10) Patent No.: US 9,506,714 B1
(45) Date of Patent: Nov. 29, 2016

(54) ADJUSTABLE PULLEY ASSEMBLY FOR A COMPOUND ARCHERY BOW

(71) Applicant: BowTech, Inc., Eugene, OR (US)

(72) Inventors: Christopher J. Eacker, Eugene, OR (US); Nicholas C. Obteshka, Springfield, OR (US); Dylan G. Rinker, Eugene, OR (US)

(73) Assignee: BOWTECH, INC., Eugene, OR (US)

( * ) Notice: Subject to any disclaimer, the term of this patent is extended or adjusted under 35 U.S.C. 154(b) by 0 days.

(21) Appl. No.: 15/091,572

(22) Filed: Apr. 6, 2016

(51) Int. Cl.
*F41B 5/10* (2006.01)

(52) U.S. Cl.
CPC *F41B 5/105* (2013.01); *F41B 5/10* (2013.01)

(58) Field of Classification Search
CPC ..... F41B 5/10; F41B 5/105
See application file for complete search history.

(56) References Cited

U.S. PATENT DOCUMENTS

| | | | |
|---|---|---|---|
| 4,519,374 | A | 5/1985 | Miller |
| 4,562,824 | A | 1/1986 | Jennings |
| 4,660,536 | A | 4/1987 | McPherson |
| 4,926,832 | A | 5/1990 | Darlington |
| 4,976,250 | A | 12/1990 | Jeffrey |
| 5,678,529 | A | 10/1997 | Larson |
| 5,782,229 | A | 7/1998 | Evans et al. |
| 5,960,778 | A | 10/1999 | Larson |
| 6,067,974 | A | 5/2000 | Islas |
| 6,082,347 | A | 7/2000 | Darlington |
| 6,112,732 | A | 9/2000 | Larson |
| 6,155,243 | A | 12/2000 | Gallops, Jr. |
| 6,250,293 | B1 | 6/2001 | Andrews |
| RE37,544 | E | 2/2002 | Darlington |
| 6,446,619 | B1 | 9/2002 | McPherson |
| 6,460,528 | B1 | 10/2002 | Gallops, Jr. |
| 6,474,324 | B1 | 11/2002 | Despart et al. |
| 6,516,790 | B1 | 2/2003 | Darlington |
| 6,575,153 | B2 | 6/2003 | Lommasson et al. |
| 6,718,963 | B1 | 4/2004 | Wheeler |
| 6,792,930 | B1 | 9/2004 | Kronengold et al. |
| 6,871,643 | B2 | 3/2005 | Cooper et al. |
| 6,966,312 | B1 | 11/2005 | Larson |
| 6,976,484 | B1 | 12/2005 | Gallops, Jr. |
| 6,990,970 | B1 | 1/2006 | Darlington |
| 7,082,937 | B1 | 8/2006 | Land |
| 7,305,979 | B1 | 12/2007 | Yehle |
| 7,311,098 | B2 | 12/2007 | Gallops, Jr. |
| 7,673,626 | B1 | 3/2010 | Hennings |
| 7,690,372 | B2 | 4/2010 | Cooper et al. |
| 7,721,721 | B1 | 5/2010 | Kronengold et al. |
| 7,770,568 | B1 | 8/2010 | Yehle |
| 8,020,544 | B2 | 9/2011 | McPherson et al. |

(Continued)

OTHER PUBLICATIONS

Allowance dated Mar. 21, 2016 in co-owned U.S. Appl. No. 14/318,640 (published as US 2015/0377581; issued as U.S. Pat. No. 9,347,730).

(Continued)

*Primary Examiner* — John Ricci
(74) *Attorney, Agent, or Firm* — David S. Alavi

(57) ABSTRACT

A pulley assembly for a compound bow comprises a draw cable pulley and a dual-groove power module attached to the draw cable pulley and adjustable among one or more positions and two orientations. A power cable is taken up into one of the two grooves depending on the power module orientation. Changing the power module orientation the power module position alters one or more of the bow's draw force curve, stored energy, draw length, or draw weight.

33 Claims, 18 Drawing Sheets

(56) References Cited

U.S. PATENT DOCUMENTS

| | | | |
|---|---|---|---|
| 8,082,910 | B1 | 12/2011 | Yehle |
| 8,205,607 | B1 | 6/2012 | Darlington |
| 8,469,013 | B1 | 6/2013 | Obteshka |
| 8,683,989 | B1 | 4/2014 | McPherson |
| 9,121,658 | B1 | 9/2015 | Darlington |
| 9,347,730 | B2 | 5/2016 | Obteshka |
| 2002/0144675 | A1 | 10/2002 | Lommasson et al. |
| 2004/0003806 | A1 | 1/2004 | Blahnik |
| 2004/0074485 | A1 | 4/2004 | Cooper et al. |
| 2005/0193998 | A1 | 9/2005 | Cooper et al. |
| 2005/0268892 | A1 | 12/2005 | Gallops |
| 2006/0000463 | A1 | 1/2006 | Gallops |
| 2009/0188482 | A1 | 7/2009 | Strother |
| 2010/0051005 | A1 | 3/2010 | Wilson |
| 2015/0377581 | A1 | 12/2015 | Obteshka |

OTHER PUBLICATIONS

Co-owned U.S. Appl. No. 14/591,007, filed Jan. 7, 2015 in the names of Hyde and Obteshka.

Office action dated Mar. 17, 2016 in co-owned U.S. Appl. No. 14/591,007.

Co-owned U.S. Appl. No. 14/797,072, filed Jul. 11, 2015 in the name of Obteshka.

FIG. 7B
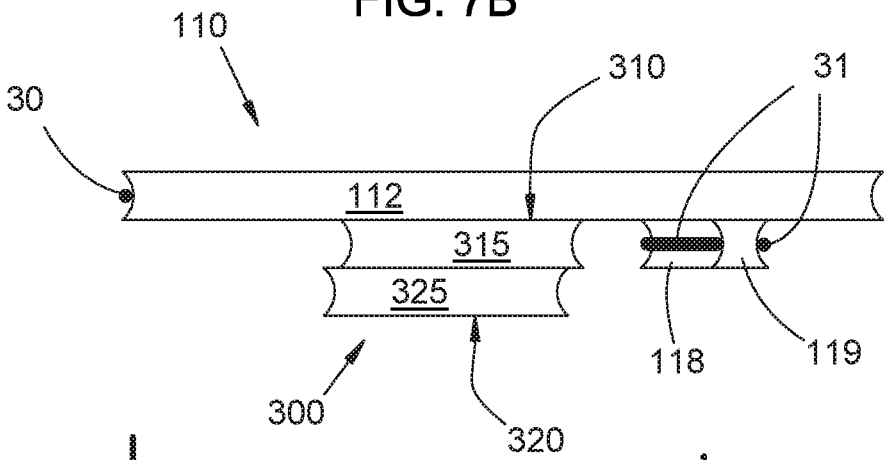
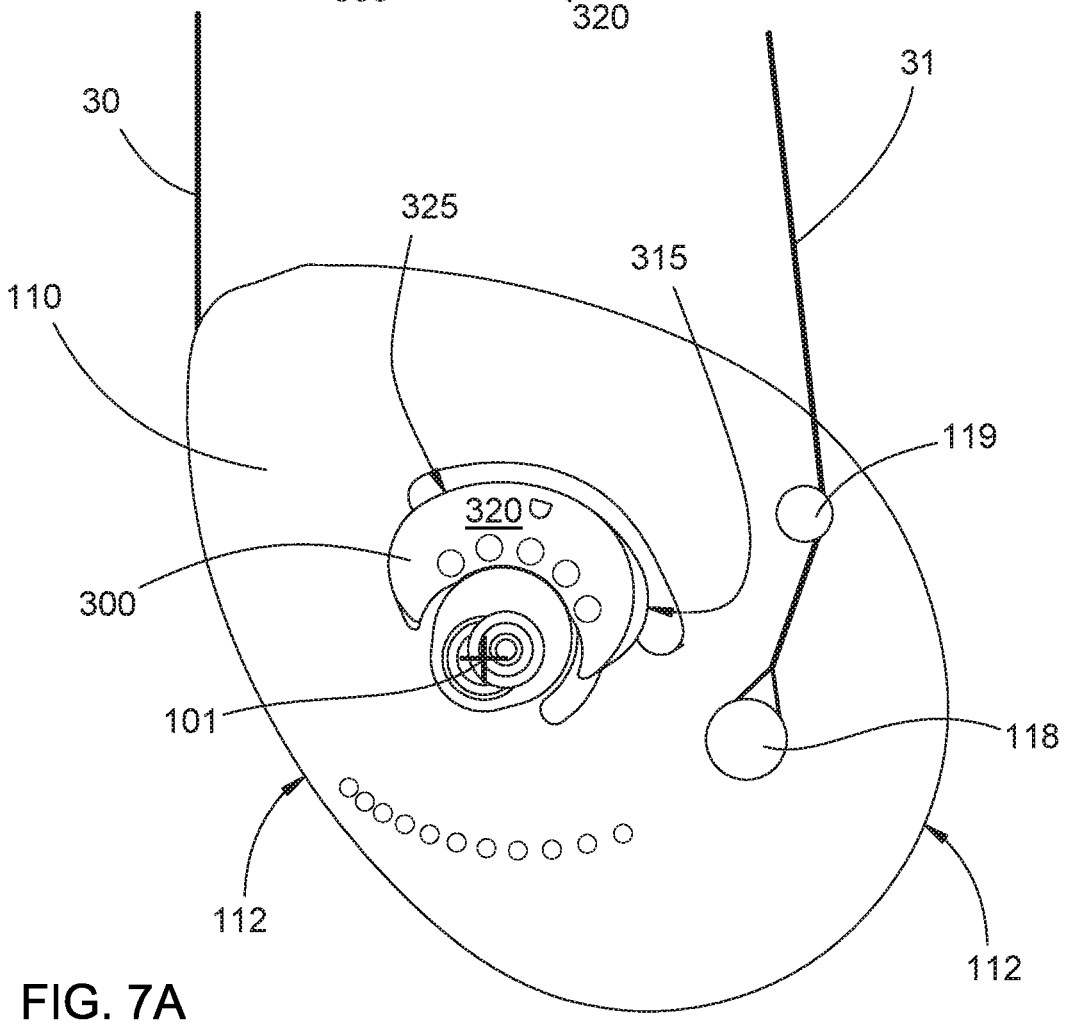
FIG. 7A

FIG. 8B
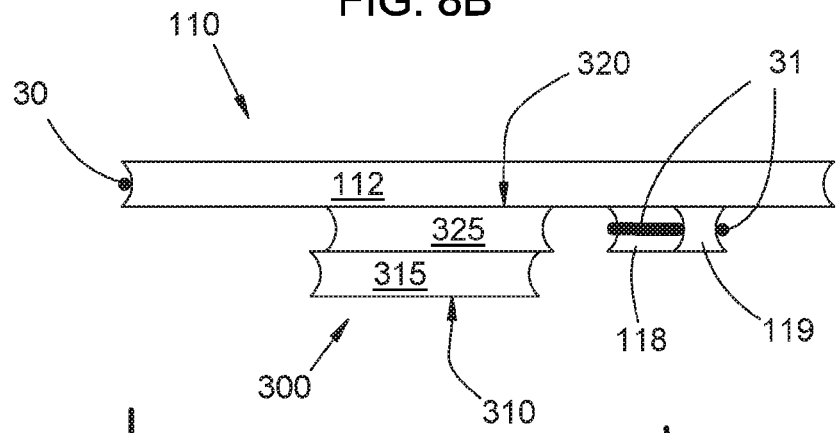
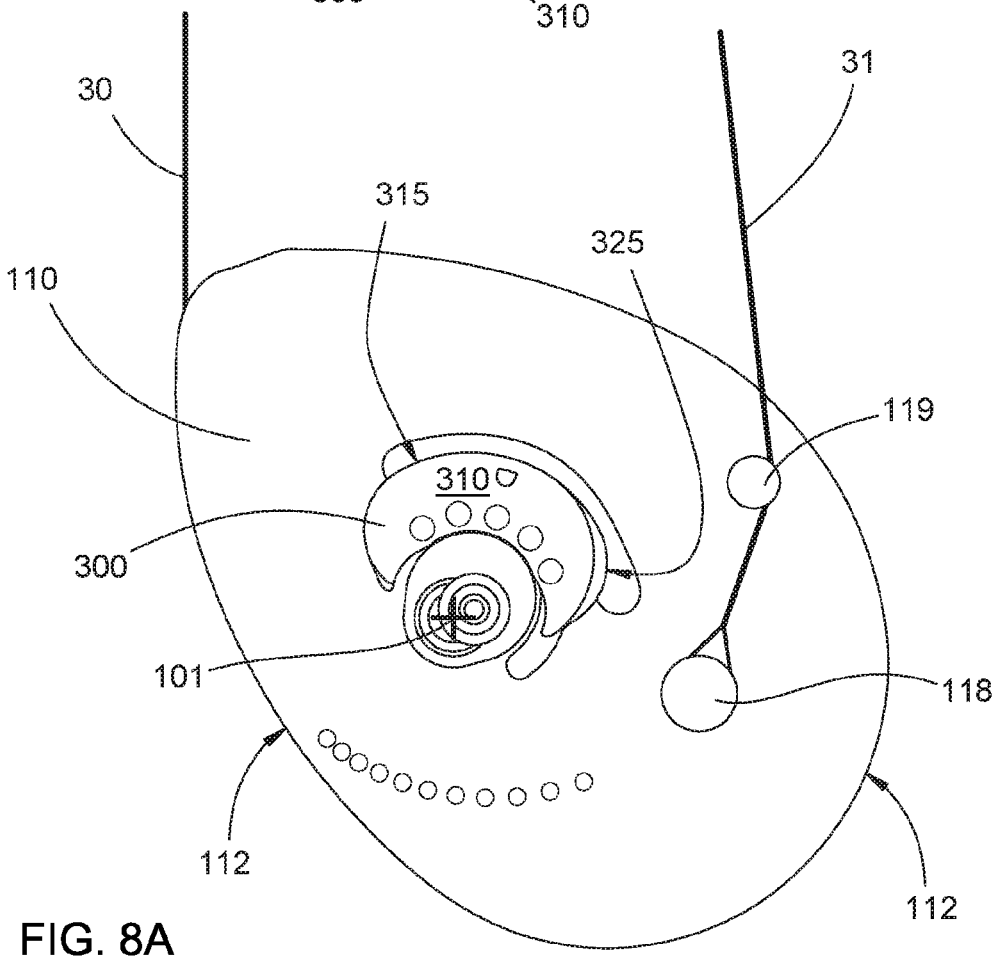
FIG. 8A

ADJUSTABLE PULLEY ASSEMBLY FOR A COMPOUND ARCHERY BOW

BACKGROUND

The field of the present invention relates to a pulley assembly for a compound archery bow. In particular, an adjustable pulley assembly is disclosed herein having a reversible, dual-groove power module mounted on a draw cable pulley for providing adjustment of one or more of the draw force curve, draw length, draw, weight, or stored energy of the drawn bow.

Several adjustable pulley assemblies are available for compound archery bows. Some examples are disclosed in: U.S. Pat. No. 7,721,721 entitled "Reversible and adjustable module system for archery bow" issued May 25, 2010 to Kronengold et al.; U.S. Pat. No. 8,020,544 entitled "Archery bow with force vectoring anchor" issued Sep. 20, 2011 to McPherson; co-owned U.S. Pat. No. 8,082,910 entitled "Pulley assembly for a compound archery bow" issued Dec. 27, 2011 to Yehle; co-owned application Ser. No. 14/318,640 entitled "Adjustable pulley assembly for a compound archery bow" filed Jun. 28, 2014 in the name of Obteshka; co-owned application Ser. No. 14/591,007 entitled "Adjustable pulley assembly for a compound archery bow" filed Jan. 7, 2015 in the names of Hyde and Obteshka; and co-owned application Ser. No. 14/797,072 entitled "Adjustable pulley assembly for a compound archery bow" filed Jul. 11, 2015 in the name of Obteshka. Application Ser. No. 14/318,640, application Ser. No. 14/591,007, and application Ser. No. 14/797,072 are incorporated by reference as if fully set forth herein.

SUMMARY

A pulley assembly for a compound archery bow comprises a draw cable pulley and a dual-groove power module substantially rigidly attached to the draw cable pulley. The draw cable pulley is structurally arranged so as to (i) define a first pulley assembly transverse rotation axis, (ii) be mounted on a first limb of an archery bow to rotate about the first pulley assembly axis, (iii) receive a first end of a draw cable of the bow in a circumferential draw cable groove of the draw cable pulley, and (iv) let out the first end of the draw cable from the draw cable groove when the bow is drawn and the draw cable pulley rotates about the first pulley assembly axis. One or both of the draw cable pulley and the dual-groove power module are structurally arranged so as to enable substantially rigid, removable attachment of the dual-groove power module to the draw cable pulley in any one of one or more power module positions and, for each power module position, in any one of first or second power module orientations. The dual-groove power module has opposite first and second faces, a first circumferential power cable groove adjacent the first face, and a second circumferential power cable groove adjacent the second face. The dual-groove power module is structurally arranged, when attached to the draw cable pulley in the first power module orientation with the first face facing the draw cable pulley, so as to (i) receive a power cable of the bow in the first circumferential power cable groove, and (ii) take up the power cable into the first power cable groove when the bow is drawn and the draw cable pulley rotates about the first pulley assembly axis. The dual-groove power module is structurally arranged, when attached to the draw cable pulley in the second power module orientation with the second face facing the draw cable pulley, so as to (i) receive the power cable of the bow in the second circumferential power cable groove, and (ii) take up the power cable into the second power cable groove when the bow is drawn and the draw cable pulley rotates about the first pulley assembly axis. For each one of the one or more power module positions, the first and second power module orientations result in corresponding draw force curves of the bow that differ substantially from each other.

A method for adjusting the pulley assembly comprises: (A) removing the dual-groove power module from one of the one or more power module positions and one of the first or second power module orientations on the draw cable pulley; and (B) reattaching the dual-groove power module to the draw cable pulley in a different one of the one or more power module positions or in a different one of the first or second power module orientations, (C) thereby substantially altering one or more of stored energy of the drawn bow, draw length of the bow, or draw weight of the bow.

An archery bow comprises a central riser, first and second bow limbs secured to opposing ends of the riser, first and second pulley assemblies rotatably mounted on the first and second bow limbs, respectively, a draw cable and a power cable. One or both of the pulley assemblies is arranged as described above. Instead of a second pulley assembly, an idler wheel can be rotatably mounted on the second bow limb.

Objects and advantages pertaining to pulley assemblies for compound bows may become apparent upon referring to the example embodiments illustrated in the drawings and disclosed in the following written description or appended claims.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

FIGS. 7A and 7B are schematic right side and top views, respectively, of the dual-groove power module of FIGS. 6A-6C mounted on the draw cable pulley member of FIGS. 5A and 5B in a first one of two power module orientations.

FIGS. 8A and 8B are schematic right side and top views, respectively, of the dual-groove power module of FIGS.

Figure 5A:
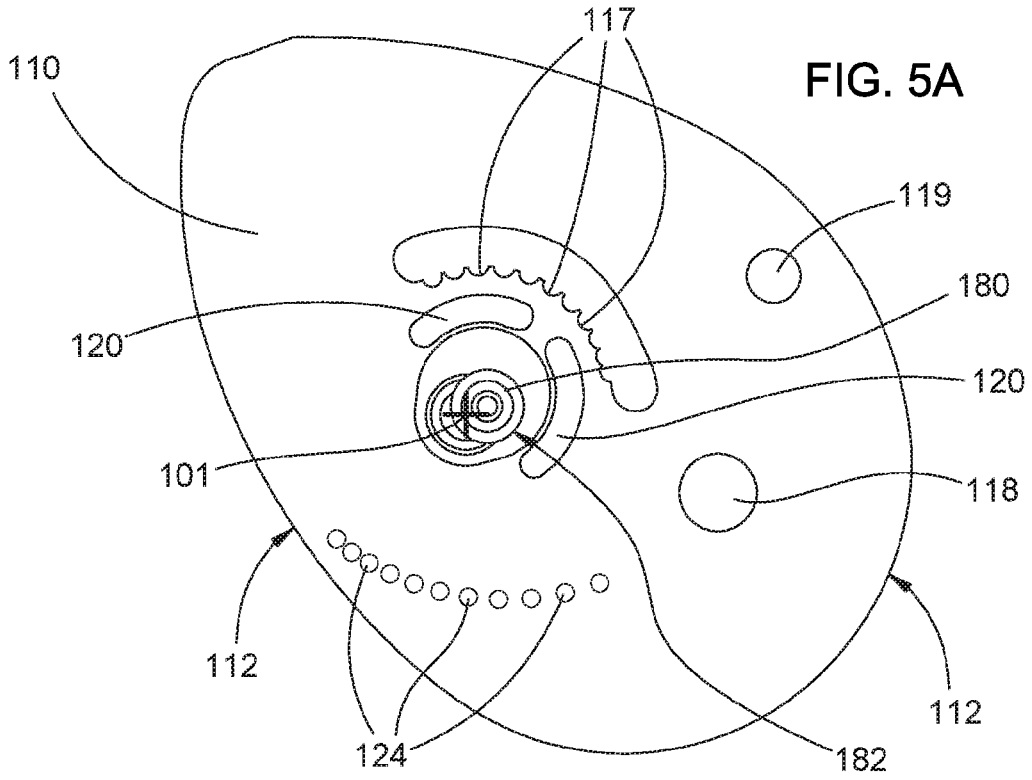
FIGS. 5A and 5B are schematic right and left side views, respectively, of an example draw cable pulley member of an example inventive pulley assembly, including a power cable let-out mechanism.
Figure 5B:
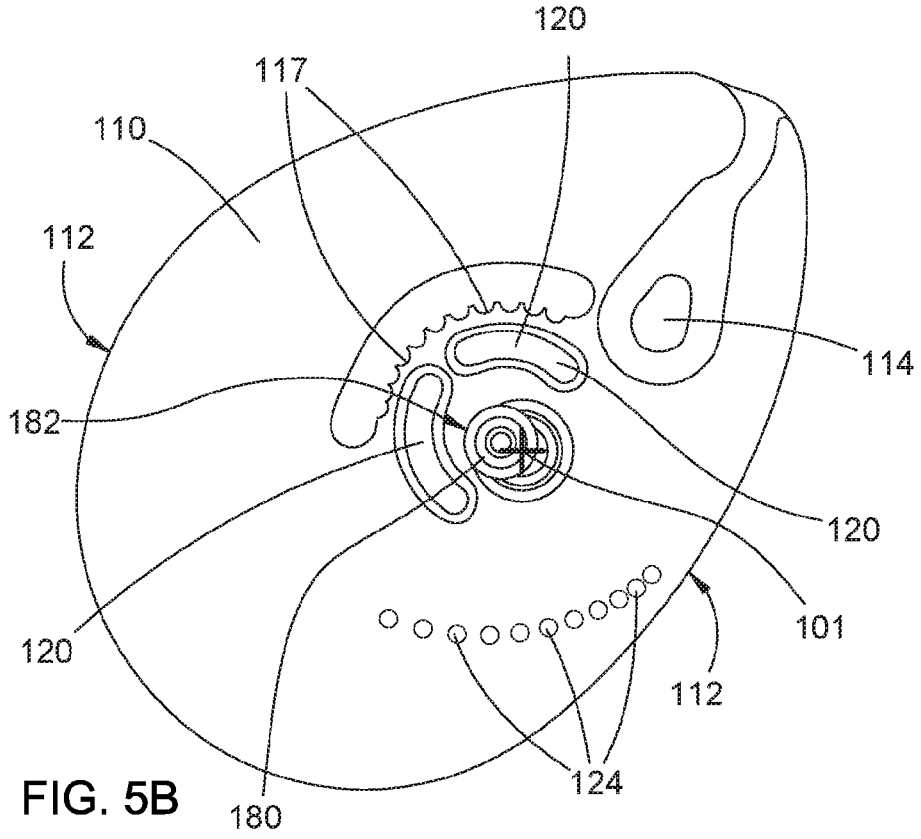
Figure 6A:
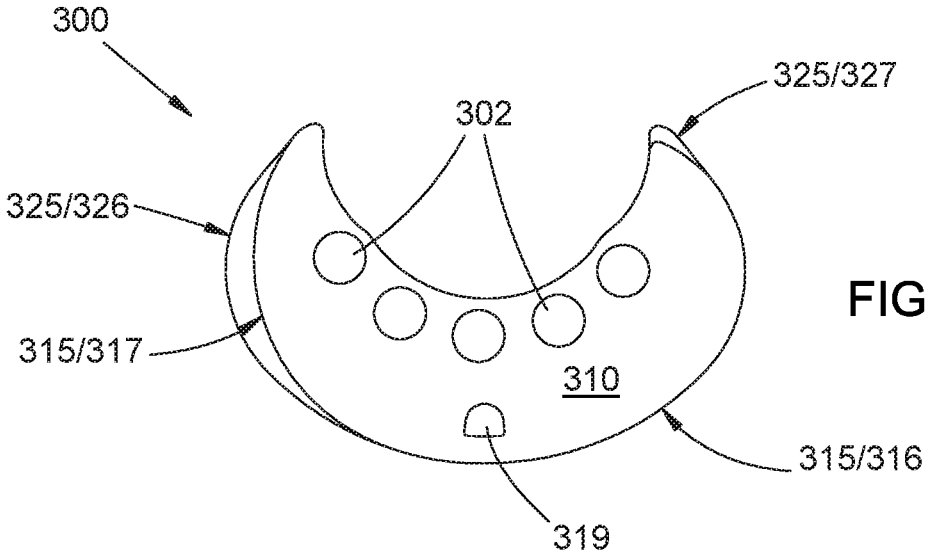
FIGS. 6A through 6C are schematic two side views and one edge view, respectively, of an example dual-groove power module of an example inventive pulley assembly.
Figure 6C:
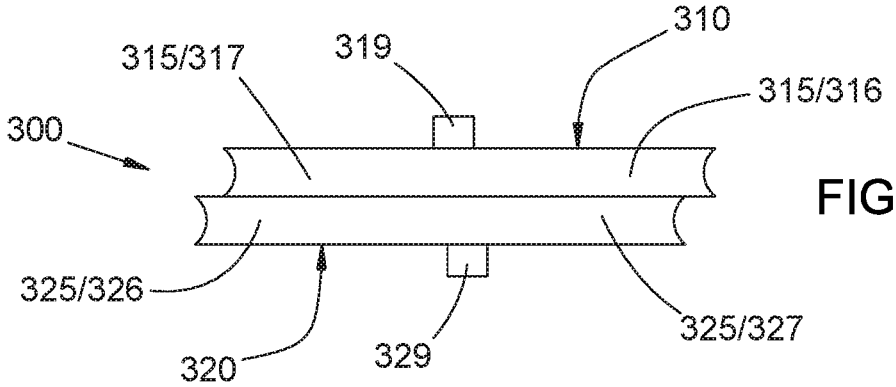
Figure 6B:
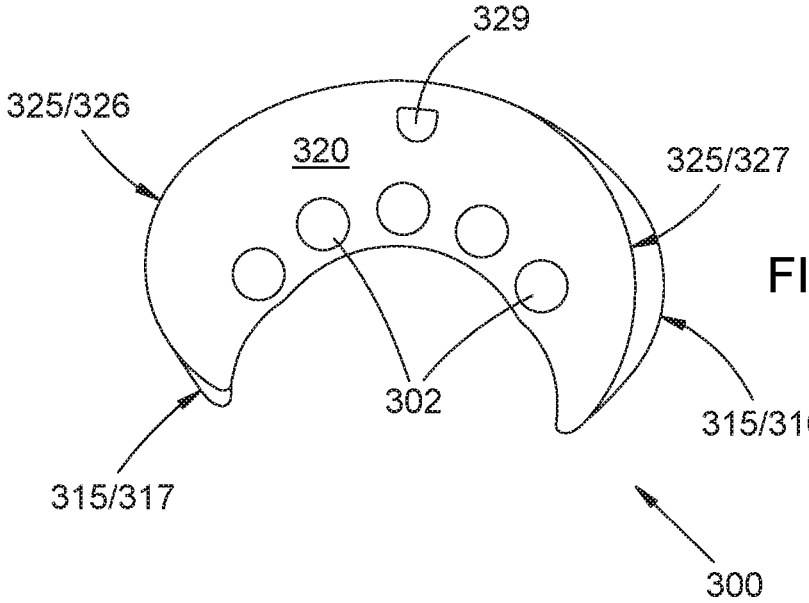

6A-6C mounted on the draw cable pulley member of FIGS. 5A and 5B in a second one of two power module orientations.

Figure 9B:
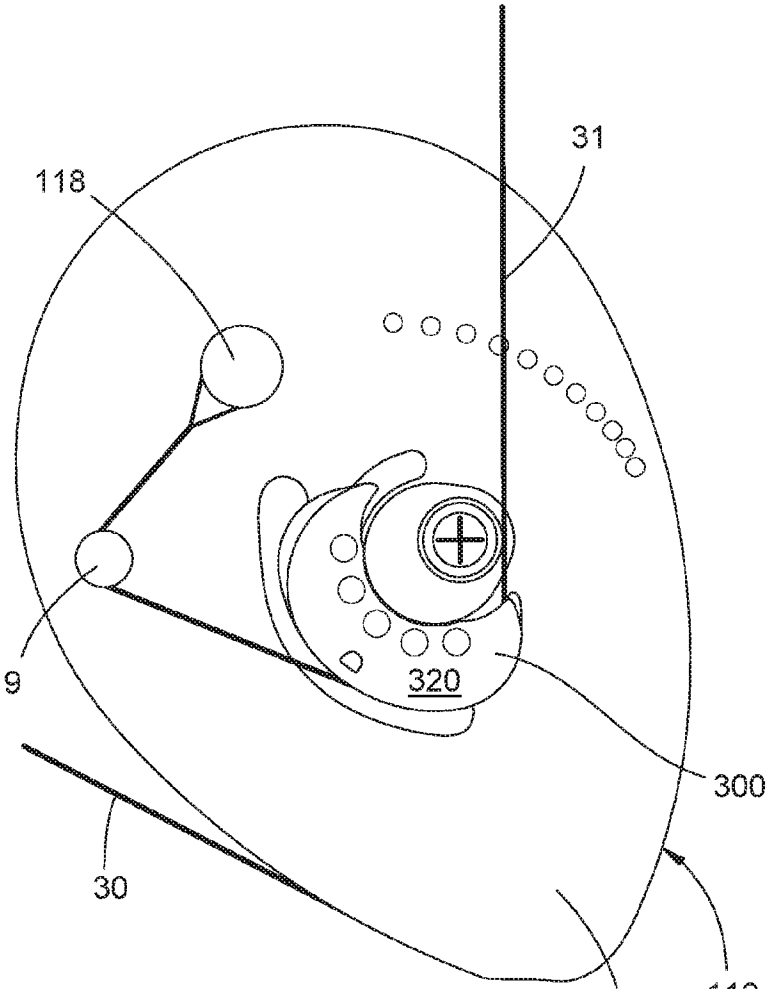
Figure 9A:
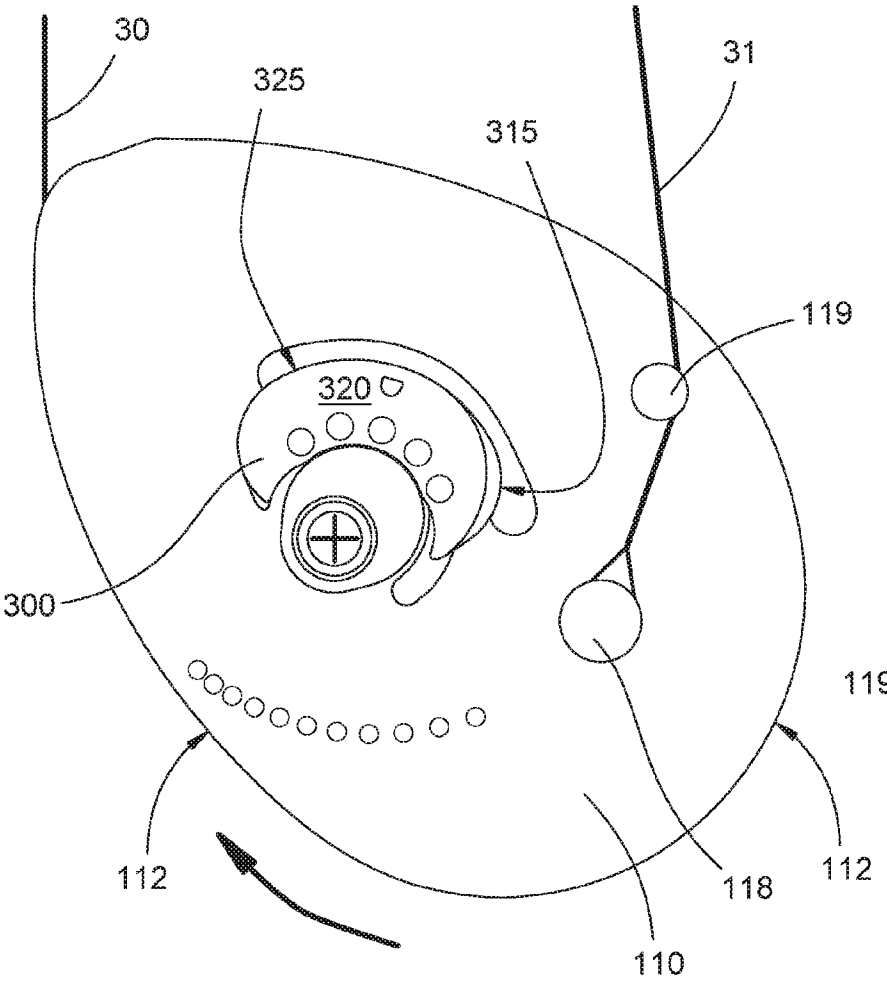

FIGS. 9A and 9B are schematic right side views of an example pulley assembly in a first arrangement for a solo cam or hybrid cam bow, at brace and at full draw, respectively. The let-out pulley is omitted for clarity.

Figure 10B:
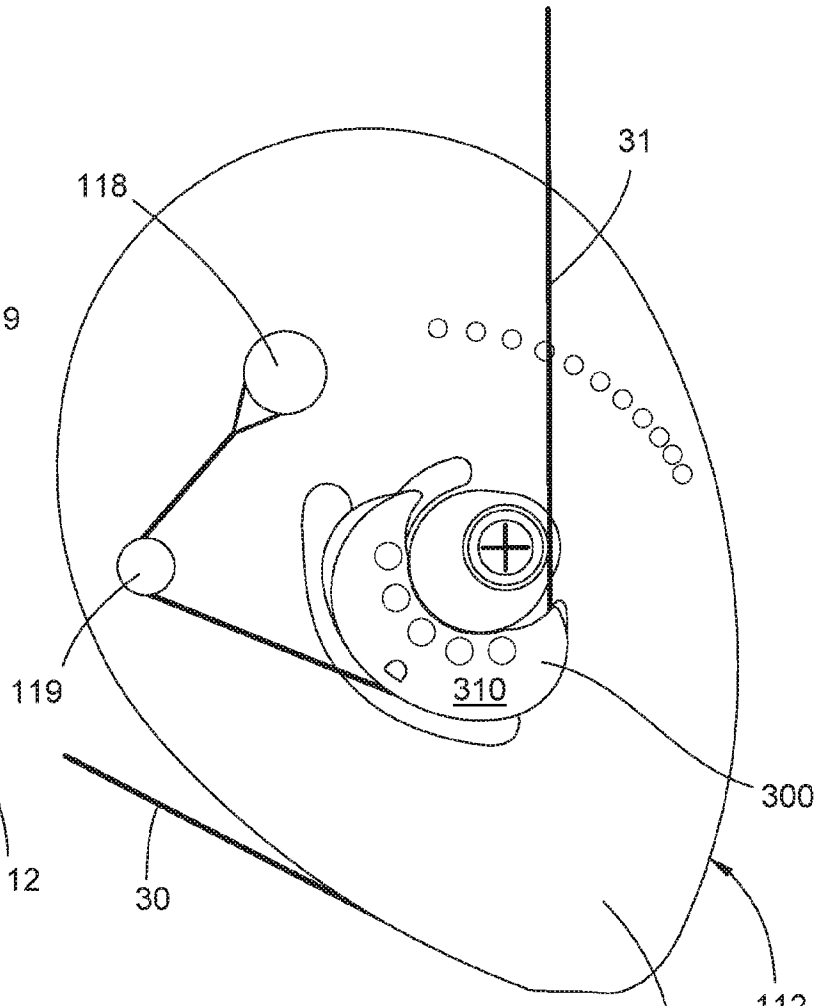
Figure 10A:
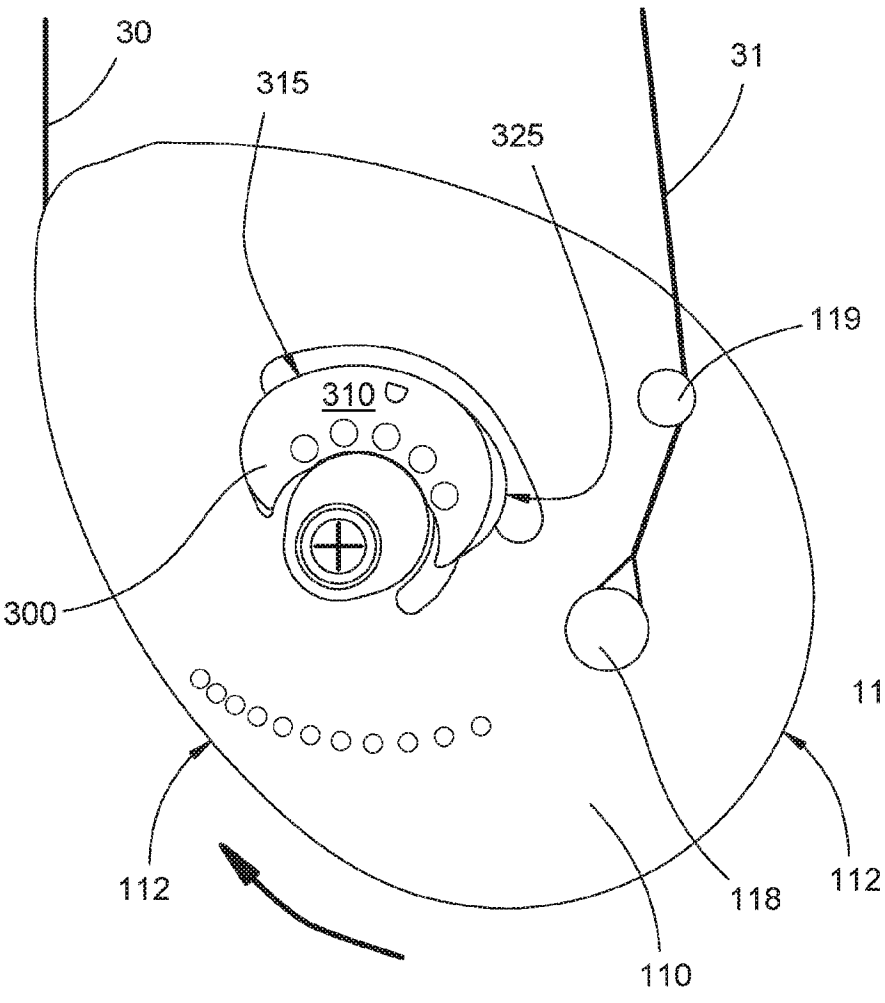

FIGS. 10A and 10B are schematic right side views of an example pulley assembly in a second arrangement on a solo cam or hybrid cam bow, at brace and at full draw, respectively. The let-out pulley is omitted for clarity.

Figure 11A:
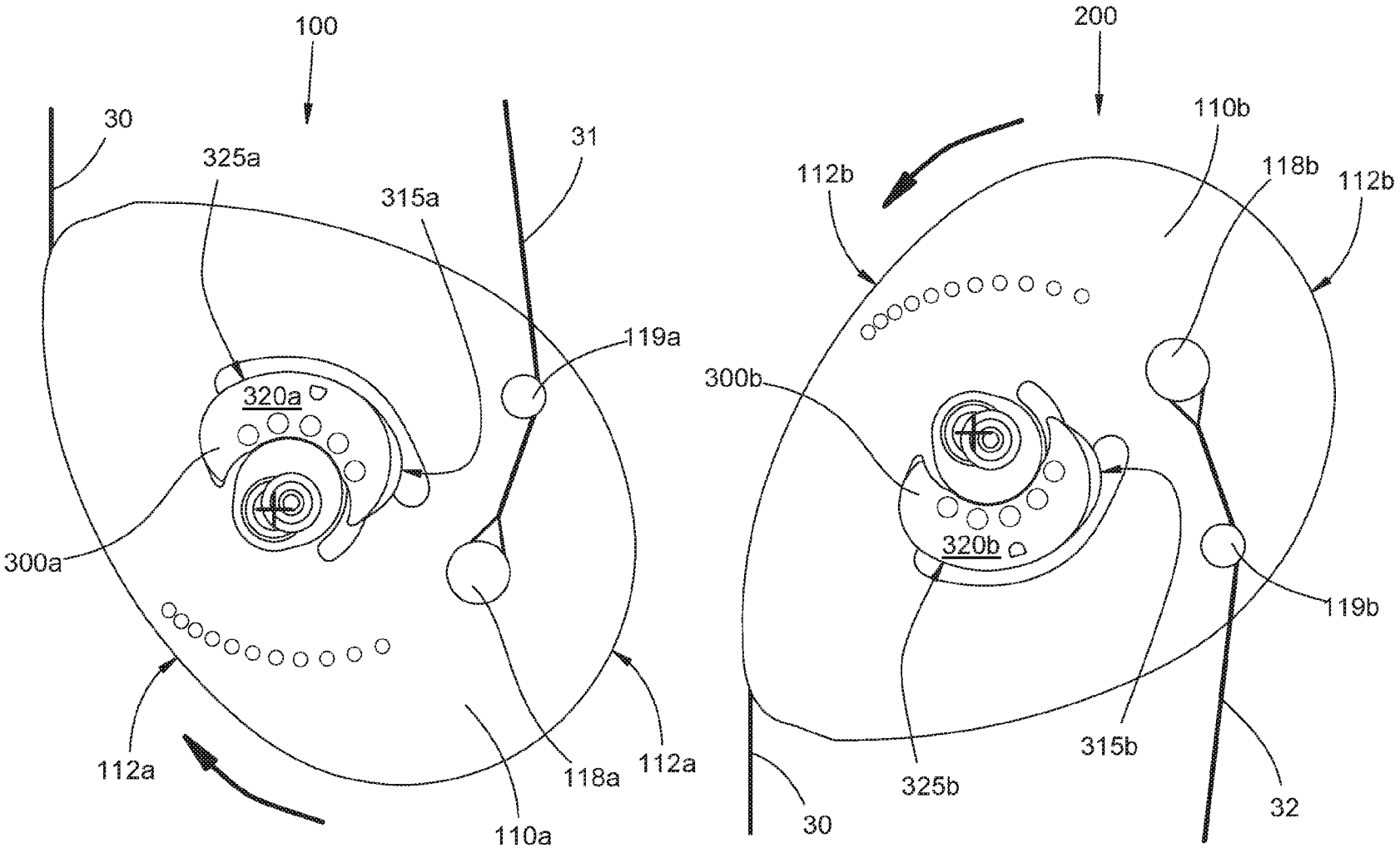
Figure 11B:
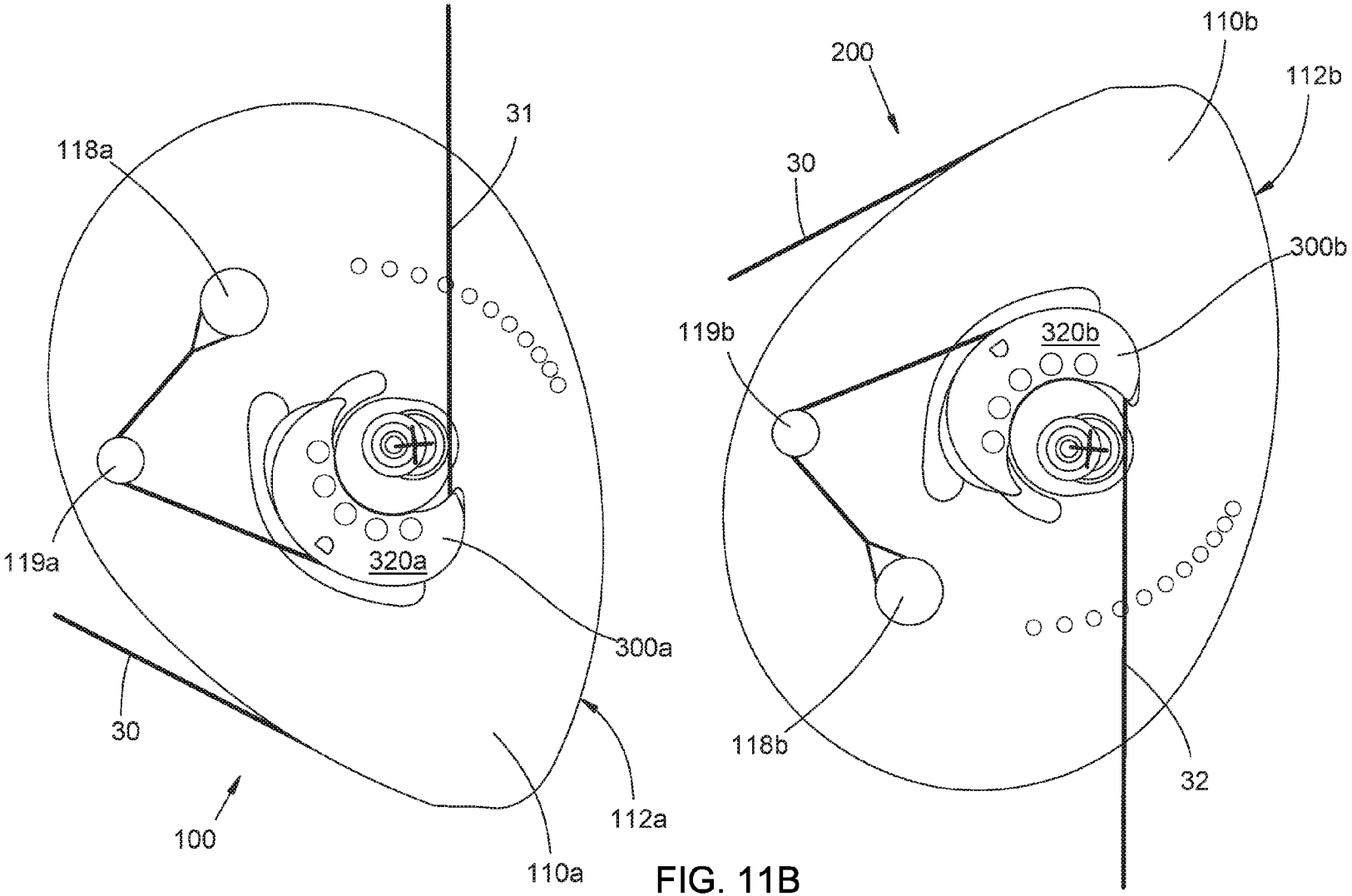

FIGS. 11A and 11B are schematic right side views of a pair of example pulley assemblies in a first arrangement for a binary cam bow, at brace and at full draw, respectively.

Figure 12A:
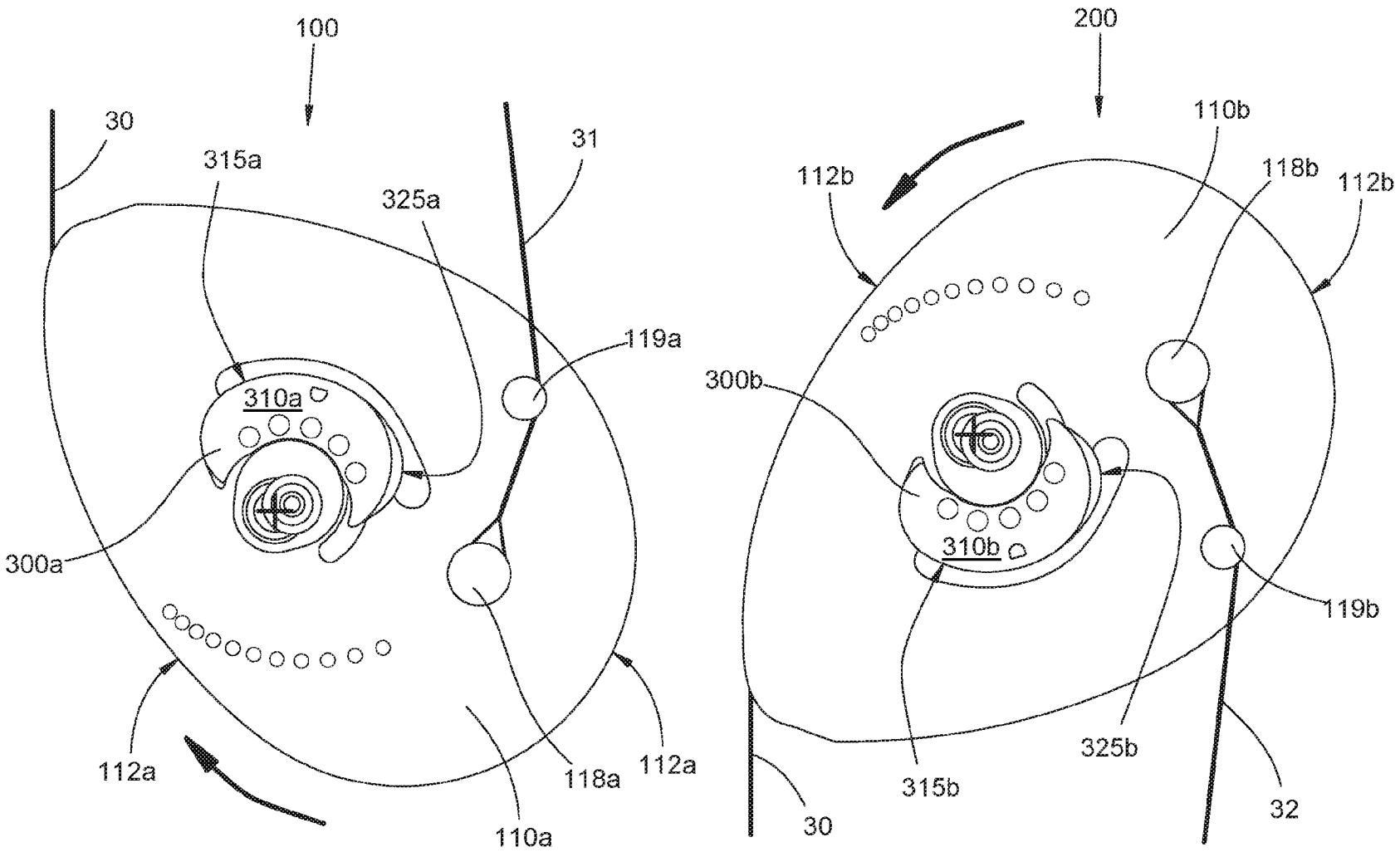
Figure 12B:
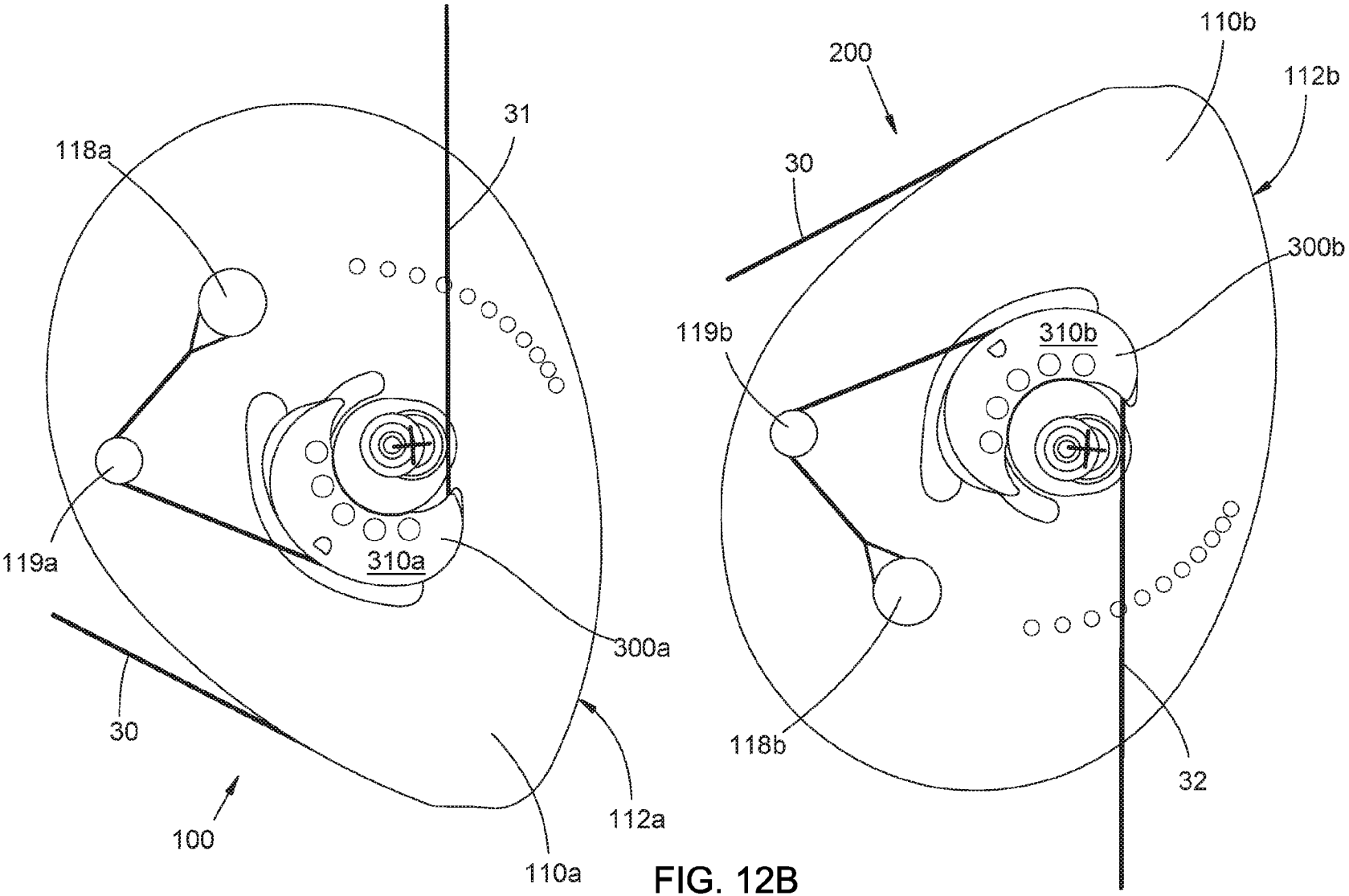

FIGS. 12A and 12B are schematic right side views of a pair of example pulley assemblies in a second arrangement for a binary cam bow, at brace and at full draw, respectively.

Figure 13A:
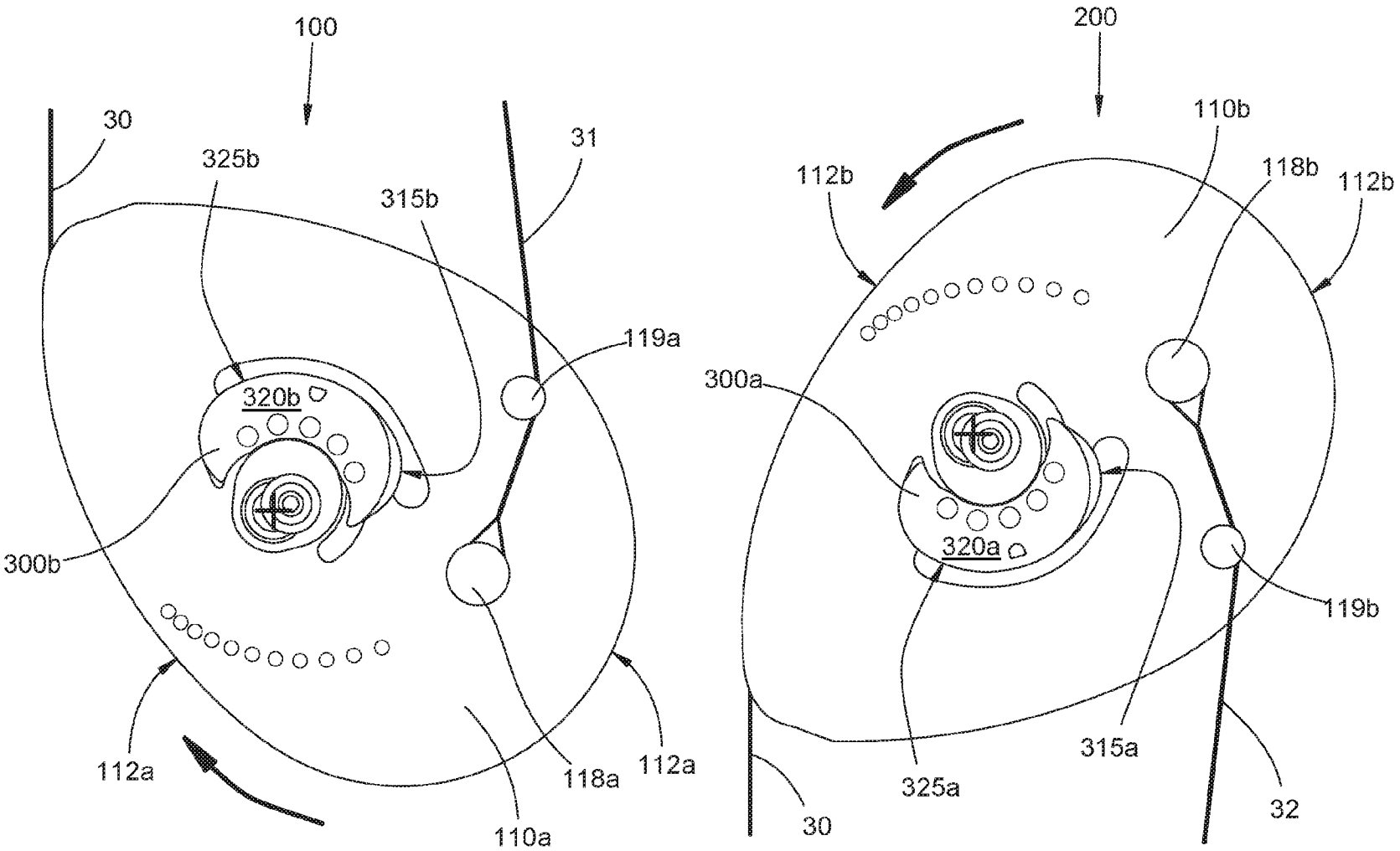
Figure 13B:
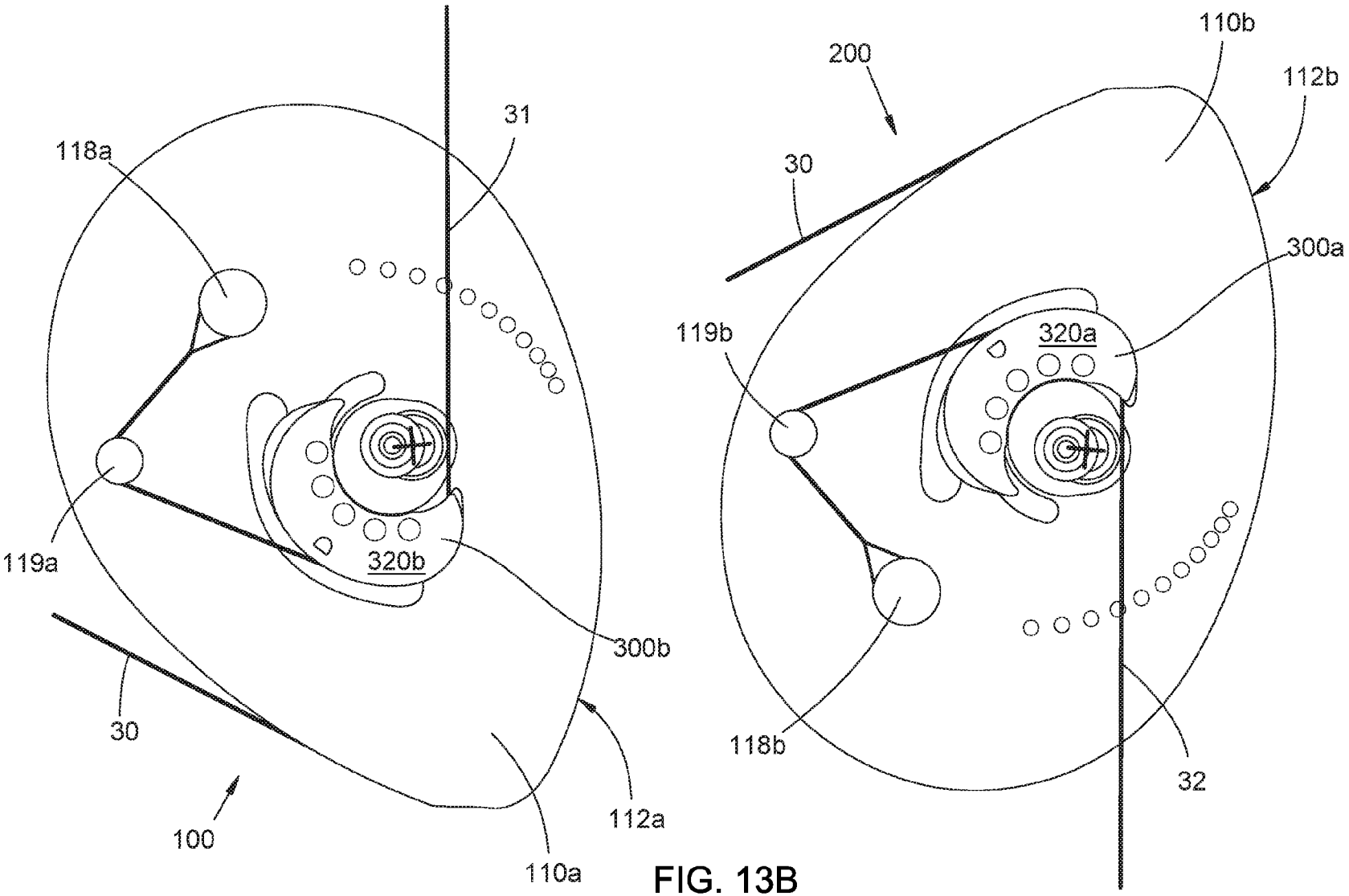

FIGS. 13A and 13B are schematic right side views of a pair of example pulley assemblies in a third arrangement for a binary cam bow, at brace and at full draw, respectively.

Figure 14A:
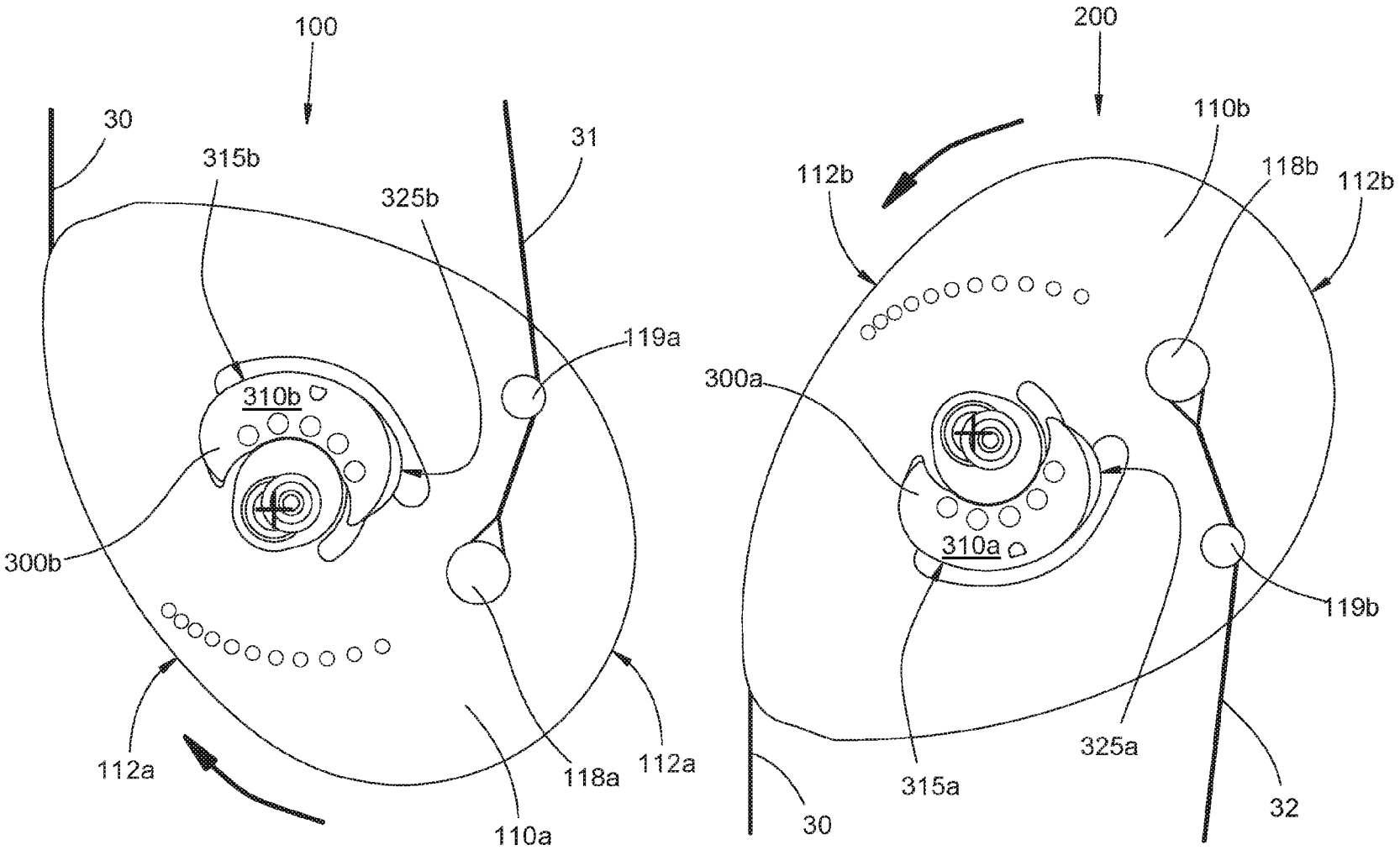
Figure 14B:
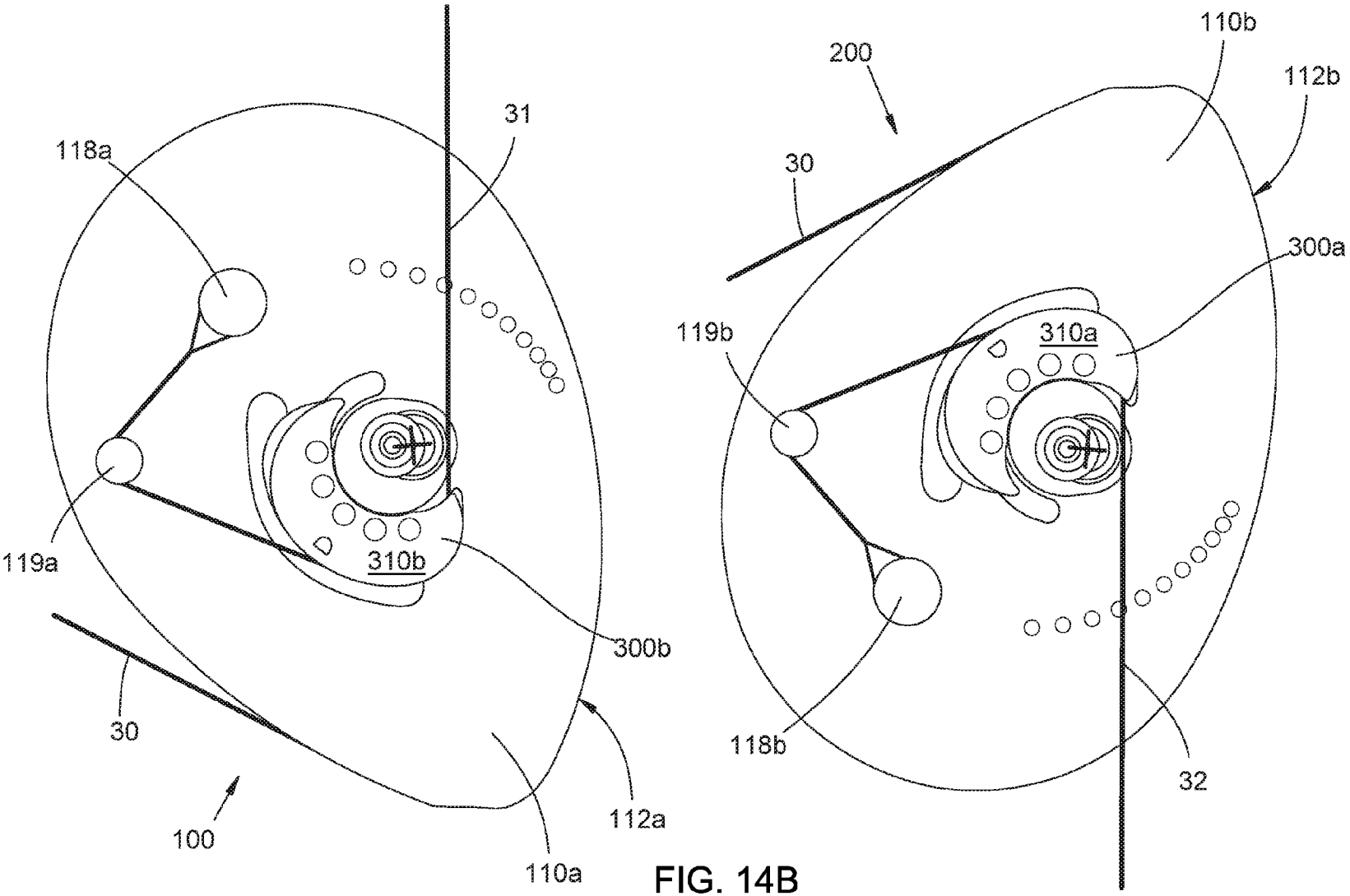

FIGS. 14A and 14B are schematic right side views of a pair of example pulley assemblies in a fourth arrangement for a binary cam bow, at brace and at full draw, respectively.

The embodiments depicted are shown only schematically: all features may not be shown in full detail or in proper proportion, certain features or structures may be exaggerated relative to others for clarity, and the drawings should not be regarded as being to scale. In particular, the power module grooves in the various drawings may all appear very similar, but only small differences between the grooves, not readily discernible from the drawings, are needed to alter the draw force curve of the bow in a discernible way. The embodiments shown are only examples: they should not be construed as limiting the scope of the present disclosure or appended claims. In particular, the arrangement of the riser and limbs shown in FIGS. 1-4 are illustrative only; any suitable arrangement of the riser and bow limbs can be employed within the scope of the present disclosure or appended claims.

DETAILED DESCRIPTION OF EMBODIMENTS

A compound archery bow comprises a central riser 10, first and second bow limbs 11 and 12 secured to opposing ends of the riser 10, first and second pulley assemblies 100 and 200 rotatably mounted on the first and second bow limbs 11 and 12, respectively, a draw cable 30, and a power cable 31. If the bow is a so-called dual cam bow (FIG. 1) or a so-called binary cam bow (FIG. 2), then the bow includes a second power cable 32 and the first and second pulley assemblies 100 and 200 are replicas or, more typically, mirror images of each other (meaning, for purposes of the present disclosure and appended claims, that they are replicas or mirror images to within the applicable manufacturing tolerances, so that any differences are small enough so as to produce no effect on performance of the bow that would be discernable to a typical user). Upon drawing a dual cam bow, the draw cable 30 is let out by both pulley assemblies 100 and 200, the power cable 31 (which is attached, directly or indirectly, to the second bow limb 12) is taken up by the first pulley assembly 100, and the second power cable 32 (which is attached, directly or indirectly, to the first bow limb 11) is taken up by the second pulley assembly 200. Upon drawing a binary cam bow, the draw cable 30 is let out by both pulley assemblies 100 and 200, the power cable 31 is let out by the second pulley assembly 200 and taken up by the first pulley assembly 100, and the second power cable 32 is let out by the first pulley assembly 100 and taken up by the second pulley assembly 200.

If the bow is a so-called solo cam bow (FIG. 3), then instead of a second pulley assembly an idler wheel 201 is rotatably mounted on the second bow limb 12. The draw cable 30 passes around the idler wheel 201 and is connected at both ends to the first pulley assembly 100. Upon drawing a solo cam bow, both ends of the draw cable 30 are let out by the first pulley assembly 100. The power cable 31 is taken up at its first end by the first pulley assembly 100; the second end of the power cable 31 typically is attached, directly or indirectly to the second bow limb 12; in some examples the power cable 31 instead can be let out by a power cable let-out pulley coupled to the idler wheel 201 (in a manner similar to that of a binary cam bow). If the bow is a so-called hybrid cam bow (FIG. 4), then the bow includes an additional coupling cable 33 connected to the first and second pulley assemblies 100 and 200. Upon drawing a hybrid cam bow, the draw cable 30 is let out by both pulley assemblies 100 and 200 and the coupling cable 33 is let out by the first pulley assembly 100 and taken up by the second pulley assembly 200. The power cable 31 is taken up at its first end by the first pulley assembly 100; the second end of the power cable 31 typically is attached, directly or indirectly to the second bow limb 12; in some examples the power cable 31 instead can be let out by a power cable let-out pulley of the second pulley assembly 200 (in a manner similar to that of a binary cam bow).

Figure 1:
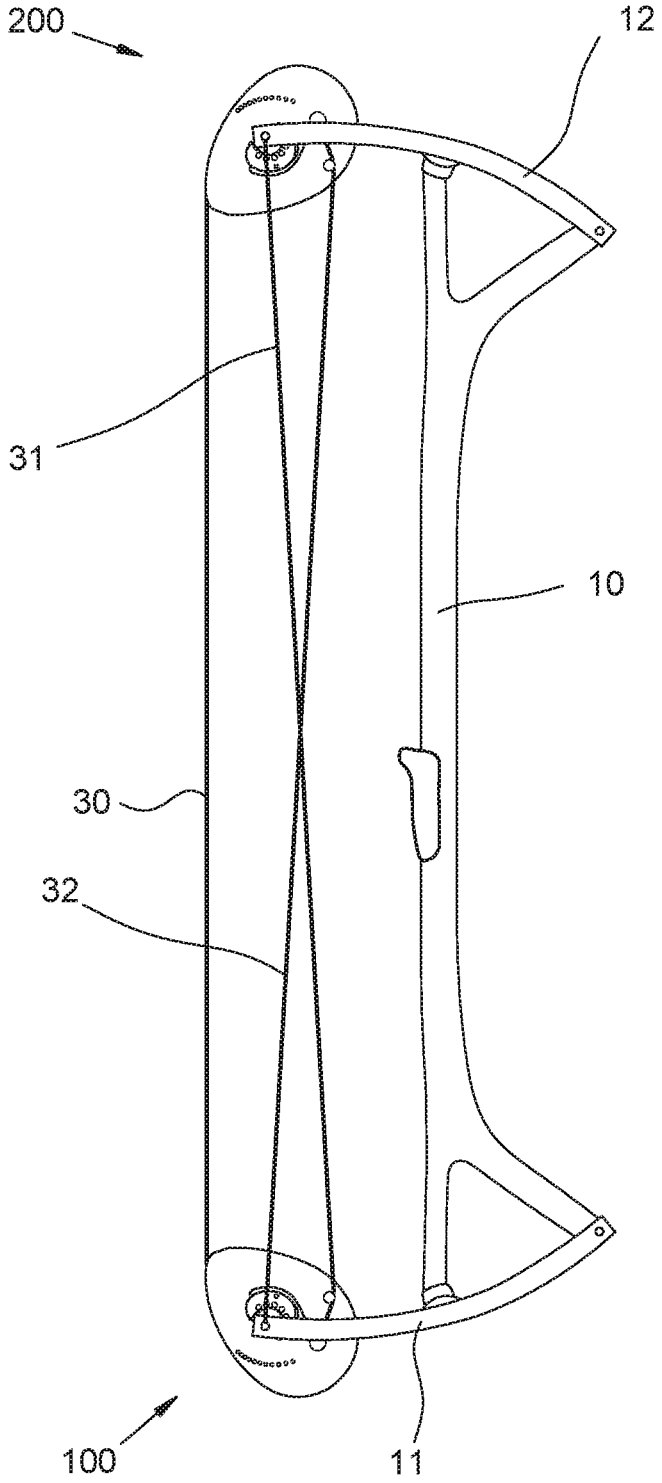
FIG. 1 illustrates schematically an example of a so-called dual cam archery bow incorporating a pair of example inventive pulley assemblies.
Figure 2:
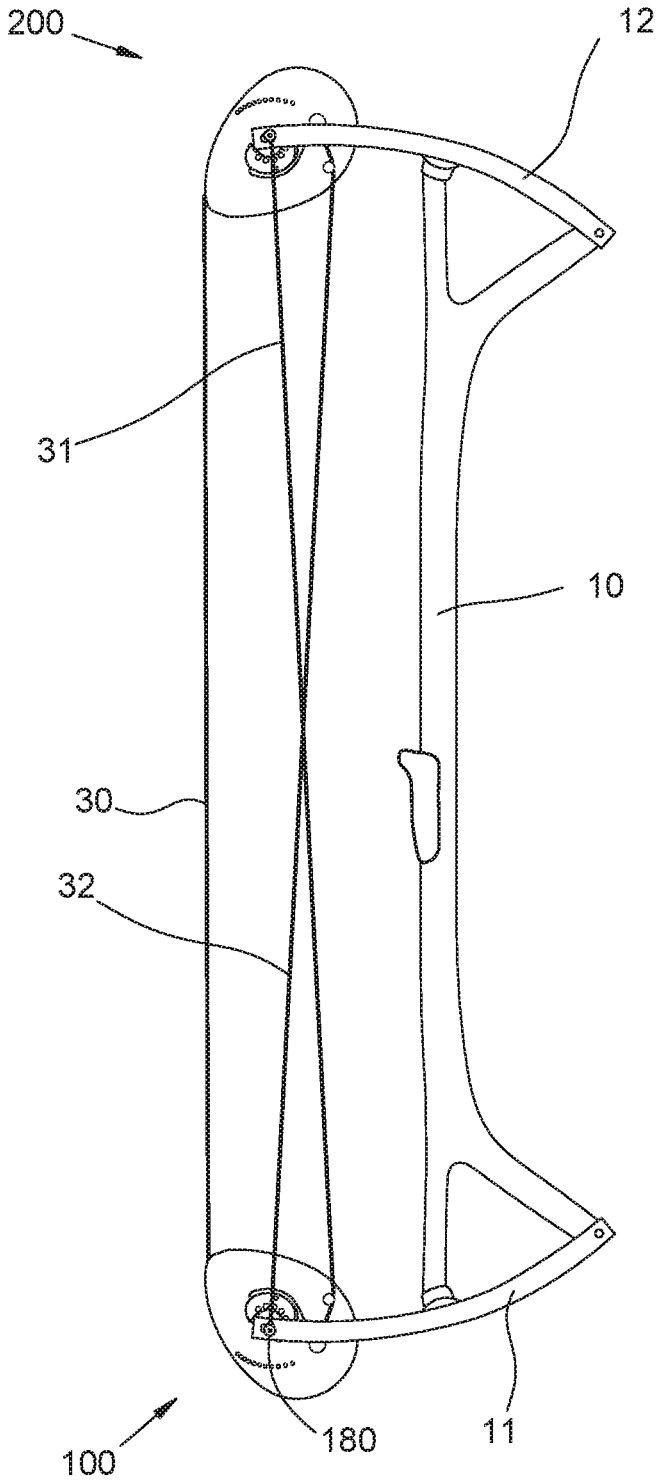
FIG. 2 illustrates schematically an example of a so-called binary cam archery bow incorporating another pair of example inventive pulley assemblies.
Figure 3:
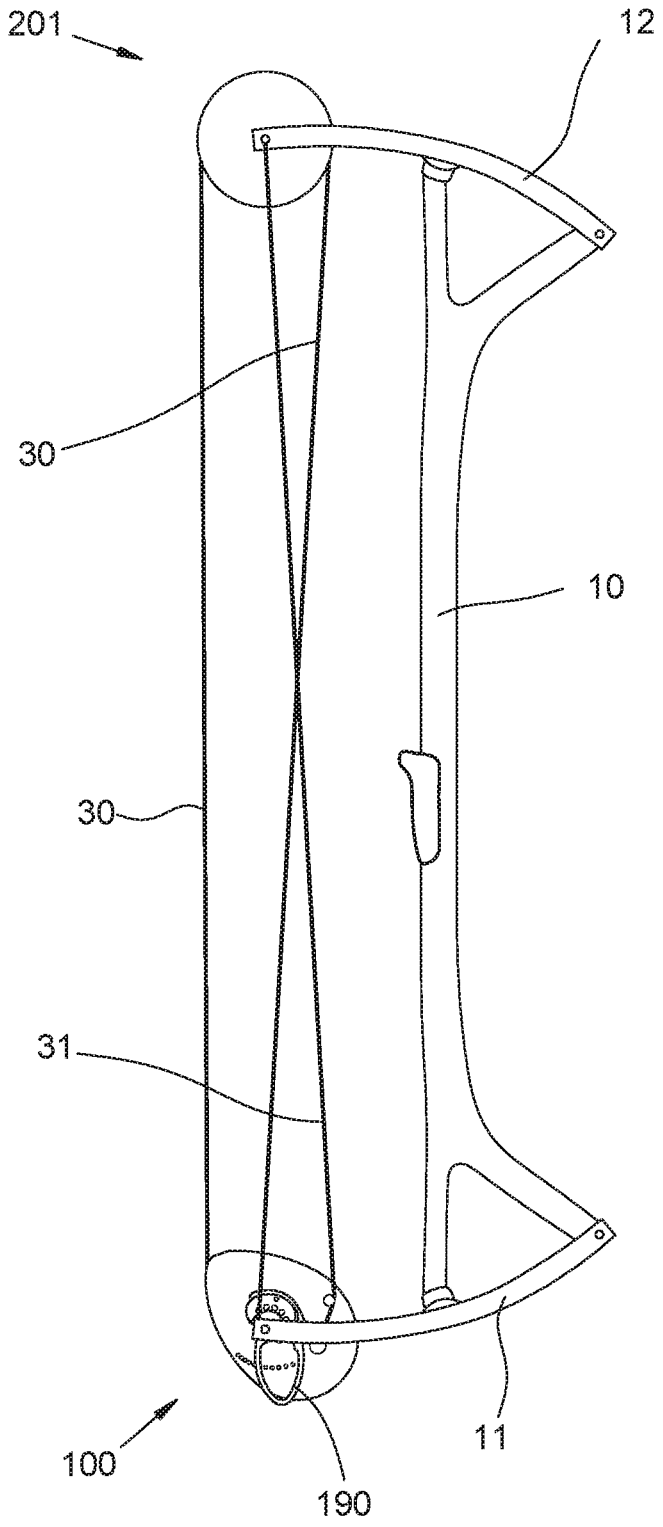
FIG. 3 illustrates schematically an example of a so-called solo cam archery bow incorporating another example inventive pulley assembly.
Figure 4:
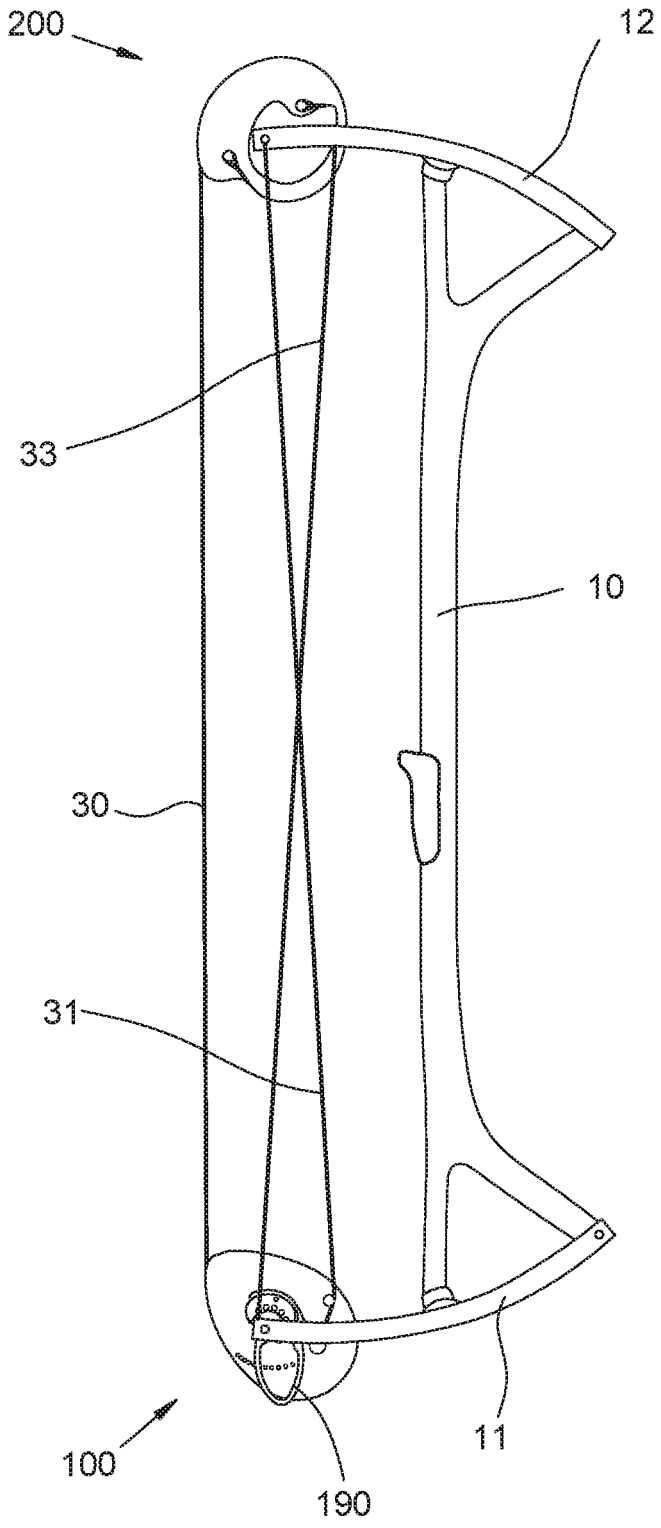
FIG. 4 illustrates schematically an example of a so-called hybrid cam archery bow incorporating another example inventive pulley assembly.

An example of an inventive pulley assembly 100 is shown in FIGS. 5A through 8B; the example shown is arranged for use in a binary cam bow (as in FIG. 2). As noted above, the pulley assembly 200 in a dual or hybrid cam bow can be a replica or mirror image of the pulley assembly 100, and the following description can apply to both pulley assemblies 100 and 200 of such bows. In those cases, letter designations "a" or "b" appended to any reference number is employed to differentiate between the two mirror images in the description and drawings, when applicable. The pulley assembly 100 comprises a draw cable pulley 110 and a dual-groove power module 300 substantially rigidly attached to the draw cable pulley 110. Each of those elements can be fabricated in any suitable way from any one or more suitably strong and rigid materials; such elements are commonly fabricated by machining from aluminum; other materials or fabrication methods can be employed within the scope of the present disclosure or appended claims. The draw cable pulley 110 typically (but not necessarily) includes one or (often) more cut-out portions to reduce the overall mass and moment of inertia of the pulley assembly 100. Such cut-out areas are omitted from the examples in the drawings so as not to unduly clutter the drawings, however, pulley assemblies that include such cut-out areas shall nevertheless fall within the scope of the present disclosure or appended claims.

The draw cable pulley 110 defines a first pulley assembly transverse rotation axis 101 and is mounted on the limb 11 in any suitable manner to rotate about the first pulley assembly axis 101. "Transverse" in the context of the present disclosure and appended claims refers to a direction that is substantially perpendicular to a virtual plane in which the draw cable 30 moves as the bow is drawn (referred to as the "shooting plane"); the first pulley assembly axis 101 is substantially perpendicular to the shooting plane. Suitable mounting arrangements can include one or more of, e.g., an axle passing through the draw cable pulley 110, one or more axle segments integrally formed on the draw cable pulley 110, rotational bearings on the draw cable pulley 110 or on the limb 11, and so on; some examples are disclosed by co-owned U.S. Pat. Nos. 8,181,638, 8,469,013 and 8,739,769, and co-owned application Ser. Nos. 14/318,640 and 14/591,007; each one of said patents and applications is incorporated by reference as if fully set forth herein.

The draw cable pulley 110 (FIGS. 5A and 5B) includes a circumferential draw cable groove or journal 112 arranged around at least a portion of its periphery. A first end of the draw cable 30 is secured to the draw cable pulley 110 in any suitable way (e.g., using draw cable anchor 114) and received in the draw cable groove 112. The draw cable pulley 110 lets out the first end of the draw cable 30 from the draw cable groove 112 when the bow is drawn and the draw cable pulley 110 rotates about the first pulley assembly axis 101. The draw cable pulley 110 can be eccentrically mounted (relative to the first pulley assembly axis 101) or non-circular so as to act as a cam as it lets out the draw cable 30. The example draw cable pulley 110 includes a power cable let-out pulley 180 having a circumferential power cable let-out groove or journal 182 (suitable for a binary cam bow; can be omitted for a dual cam bow). The power cable let-out pulley 180 can comprise a separate member substantially rigidly attached to the draw cable pulley 110 or can be integrally formed with the draw cable pulley 110; in another example arrangement, the power cable let-out pulley 180 can include a split cable arrangement or a yoke arrangement engaged with paired let-out members on opposite sides of the bow limb, as disclosed in co-owned U.S. Pat. No. 8,181,638, incorporated above. A second end of the second power cable 32 is secured to the power cable let-out pulley 180 in any suitable way and received in the draw cable let-out groove 182. The power cable let-out pulley 180 lets out the second end of the second power cable 32 from the power cable let-out groove 182 when the bow is drawn (during at least a latter portion of the draw) and the draw cable pulley 110 rotates about the first pulley assembly axis 101. The power cable let-out pulley 180 can be eccentrically mounted (relative to the first pulley assembly axis 101) or non-circular so as to act as a cam as it lets out the second power cable 32.

One or both of the draw cable pulley 110 and the dual-groove power module 300 are structurally arranged so as to enable substantially rigid attachment of the dual-groove power module 300 to the draw cable pulley 110 in any one of one or more power module positions and, for each power module position, in any one of two power module orientations. In some examples, there is only a single power module position; more typically, the power module 300 can be attached to the draw cable pulley 110 in any one of multiple power module positions. "Substantially rigid attachment" indicates an attachment sufficiently rigid so that any effect on performance of the bow, due to relative movement of the power module 300 on the draw cable pulley 110, would not be discernable to a typical user of the bow. The attachment of the draw cable pulley 110 and the dual-groove power module 300 can be achieved in any suitable way. In the example in the drawings, two curved slots 120 are formed in the draw cable pulley 110, and a set of threaded holes 302 are formed in the dual-groove power module 300; other suitable numbers, shapes, or arrangements of slots 120 and corresponding holes 302 can be employed. Two screws (or another suitable number; not shown) are inserted through the slots 120 and into holes 300, and are tightened to substantially rigidly attach the dual-groove power module 300 to the draw cable pulley 110. In the example shown, with the screws loosened, the power module 300 can be moved among multiple power module positions, and then secured in any selected one of those power module positions by tightening the screws. The combination of slots 120, threaded holes 302, and screws is only one example of attachment of the dual-groove power module 300 to the draw cable pulley 110; any other suitable structural arrangement for achieving substantially rigid attachment of the dual-groove power module 300 to the draw cable pulley 110 in any one of one or more power module positions can be employed within the scope of the present disclosure or appended claims. For example, holes 302 can lack threads and threaded nuts can be employed to tighten screws in slot 120 and holes 302. In another example, a separate, intermediate mounting member (not visible in the drawings) can be employed for attaching the dual-groove power module 300 to the draw cable pulley 110 in any one of multiple power module positions. The mounting member can be substantially rigidly attached to the draw cable pulley 110 and the dual-groove power module 300 can be substantially rigidly attached to the mounting member. Examples of arrangements that include a mounting member are disclosed, e.g., in co-owned application Ser. No. 14/318,640, incorporated above.

In some examples, the slots 120 can be arranged so that the set of multiple power module positions is a continuous range of positions of the dual-groove power module 300 on the draw cable pulley 110. In other examples, including the example shown in the drawings, the set of multiple mounting power module positions can comprise a set of discrete positions of the dual-groove power module 300 on the draw cable pulley 110. In the example shown, the draw cable pulley 110 includes a set of concave scallops 117 and the dual-groove power module 300 includes pins 319 and 329 protruding from opposite faces 310 and 320, respectively. Aligning one of the pins 319 or 329 (depending on which face 310 or 320 faces the draw cable pulley 110) in one of the concave scallops 117 defines one of multiple discrete power module positions; with screws inserted through the slots 120 and tightened into the holes 302, engagement of the pin in the concave scallop constrains the dual-groove power module 300 at a corresponding fixed position relative to the draw cable pulley 110. Any other suitable structural arrangement for defining a set of discrete power module positions relative to the draw cable pulley 110 can be employed within the scope of the present disclosure or appended claims. In one such alternative example, corresponding alignment holes can be formed in both the dual-groove power module 300 and the draw cable pulley 110, e.g., similar to the arrangement disclosed in co-owned application Ser. No. 14/591,007, incorporated above.

The dual-groove power module 300 (FIGS. 6A through 6C) has opposite first and second faces 310 and 320, respectively. A first circumferential power cable groove 315, around at least a portion of the periphery of the power module 300, is adjacent the first face 310, and a second circumferential groove 325, around at least a portion of the periphery of the power module 300, is adjacent the second face 320. When attached to the draw cable pulley 110 in a first power module orientation (i.e., with the first face 310 facing the draw cable pulley 110, as in FIGS. 7A and 7B), a power cable 31 is received in the first circumferential power cable groove 315, and taken up into the first power cable groove 315 when the bow is drawn and the draw cable pulley 110 rotates about the first pulley assembly axis 101. When attached to the draw cable pulley 110 in a second power module orientation (i.e., with the second face 320 facing the draw cable pulley 110, as in FIGS. 8A and 8B), the power cable 31 is received in the second circumferential power cable groove 325, and taken up into the second power cable groove 325 when the bow is drawn and the draw cable pulley 110 rotates about the first pulley assembly axis 101. In the drawings, the groove 315 includes separately labelled portions 316 and 317, and the groove 325 includes separately labelled portions 326 and 327. There need not be any distinct boundary between the separately labelled portions of each groove, and in some instances those portions can overlap; the separate labelling is provided only for convenience of description (see below).

The first end of the first power cable 31 is secured to the draw cable pulley 110 in any suitable way (e.g., using power cable anchor 118). In either power module orientation, the dual-groove power module 300 typically is eccentrically mounted (relative to the first pulley assembly axis 101) or non-circular so as to act as a cam as it takes up the power cable 31 into the groove 315 or 325. Some examples of suitable arrangements are disclosed in incorporated, co-owned application Ser. Nos. 14/318,640 and 14/591,007 and co-owned U.S. Pat. Nos. 7,305,979, 7,770,568, 8,181,638, 8,469,013, and 8,739,769. Each of those patents is incorporated by reference as if fully set forth herein. In the example shown, the power cable 31 wraps around a post 119 (or other functionally equivalent structural member) that, together with the power cable take-up groove 315 or 325 (depending on the orientation of the power module 300), forms a composite power cable take-up pulley member. In other examples (e.g., as in application Ser. No. 14/591,007), an additional power cable take-up groove can be formed on the draw cable pulley 110; the additional power cable take-up groove acts together with groove 315 or 325 (depending on the orientation of the power module 300) to form a composite power cable take-up pulley member. In still other examples (not shown), the groove 315 or 325 (depending on the orientation of the power module 300) can act as the sole element of the power cable take-up pulley member. Pulley assemblies with or without a post, an additional power cable take-up groove, or other such similar structural member shall fall within the scope of the present disclosure or appended claims.

For each power module position, the first and second power module orientations result in corresponding draw force curves of the bow that differ substantially from each other (i.e., differing dependence of the draw force on the draw distance for the bow). The draw force curve can be characterized by, inter alia, a draw weight (i.e., the maximum force required during the draw), a draw length (i.e., a draw distance at which the draw force more or less abruptly reaches a local minimum draw force, referred to as let-off of the draw force), and an amount of stored energy of the drawn bow (i.e., the area under the draw force curve). Draw force curves, draw weights, draw lengths, or stored energies that "differ substantially" indicate differences that are discernable to a typical user of the bow; conversely, such curves or quantities that "do not differ substantially" might differ to only an extent that remains undiscernible to a typical user of the bow. To switch from one draw force curve to the other, the dual-groove power module 300 is removed from one power module orientation on the draw cable pulley 110 and reattached to the draw cable pulley 110 in the other power module orientation.

In the most extreme examples, wherein the grooves 315 and 325 of the dual-groove power module 300 serve as the sole power cable take-up pulley member, the corresponding draw force curves can be entirely dissimilar (e.g., differing with respect to draw length, draw weight, and stored energy of the drawn bow), or might differ in only certain aspects. The profiles of the grooves 315 and 325 can be arranged essentially independent of each other to result in the desired draw force curves. To switch from one draw force curve to the other, the dual-groove power module 300 is removed from one power module orientation on the draw cable pulley 110 and reattached to the draw cable pulley 110 in the other power module orientation.

In examples in which one or more structural elements of the draw cable pulley 110 form a portion of a composite power cable take-up pulley member (e.g., post 119 in the example shown), an initial portion of the draw force curve remains unchanged when the dual-groove power module 300 is changed from one power module orientation to the other (or from one power module position to another); only a latter portion of the draw force curve is altered. In the example shown, in the first power module orientation (i.e., with the first face 310 facing the draw cable pulley 110, as in FIGS. 7A and 7B), the power cable 31 is taken up by only the portion 317 of the first power cable groove 315; the portion 316 of the groove 315 does not come into contact with the power cable 31. Similarly, in the example shown, in the second power module orientation (i.e., with the second face 320 facing the draw cable pulley 110, as in FIGS. 8A and 8B), the power cable 31 is taken up by only the portion 327 of the second power cable groove 325; the portion 326 of the groove 325 does not come into contact with the power cable 31. In such examples, the latter portions of the draw force curve can differ from each other in any manner needed or desired (e.g., differing draw length, differing draw weight, or differing stored energy). In some examples, it can be desirable to alter only the stored energy while leaving the draw length and draw weight substantially unchanged; the portion 317 of groove 315 and the portion 327 of the groove 325 can be arranged to achieve that result.

In certain examples (including the one shown), the dual-groove power module 300 can be attached to the draw cable pulley in any one of multiple power module positions, in either power module orientation. For each power module orientation, each different position of the dual-groove power module 300 attached to the draw cable pulley 110 can result in one or more of: (i) a corresponding draw length of the bow that differs from a draw length resulting from at least one different power module position; (ii) a corresponding draw weight of the bow that differs from a draw weight resulting from at least one different power module position; (iii) corresponding stored energy of the drawn bow that differs from stored energy of the drawn bow resulting from at least one different power module position; or (iv) a corresponding draw force curve that differs from a draw force curve resulting from at least one different power module position.

In a solo can bow (as in FIG. 3) or a hybrid cam bow (as in FIG. 4), a single dual-groove power module 300 can be employed, and attachment in either one of the two power module orientations enables power cable 31 to be taken up into either groove 315 (with face 310 facing draw cable pulley 110; as in FIGS. 9A and 9B) or into groove 325 (with face 320 facing draw cable pulley 110; as in FIGS. 10A and 10B) to result in two corresponding differing draw force curves (or two corresponding distinct sets of draw force curves, if the dual-groove power module 300 can be attached to the draw cable pulley 110 in multiple power module positions). The two differing draw force curves (or two sets of draw force curves, if multiple power module positions are available) can be varied in any suitable or desirable way, including varying one or more of the draw weight, the draw length, or the stored energy. It may be desirable in some examples arrange the grooves 315 and 325 so as to enable alteration of the stored energy without altering the draw length or the draw weight.

In a dual cam bow (FIG. 1) or a binary cam bow (FIG. 2), two pulley assemblies 100 and 200 are employed that are replicas or, more typically, mirror images of each other. The pulley assembly 100 includes the draw cable pulley 110*a* and the dual-groove power module 300*a* (with grooves 315*a* and 325*a*), while pulley assembly 200 includes the draw cable pulley 110*b* and the dual-groove power module 300*b* (with grooves 315*b* and 325*b*). Attachment of the power module 300*a* to the draw cable pulley 110*a* and the power module 300*b* to the draw cable pulley 110*b*, in the first power module orientations (face 310*a* facing draw cable pulley 110*a*, face 310*b* facing draw cable pulley 110*b*, power cable 31 taken up into groove 315*a*, and power cable 32 taken up into groove 315*b*; as in FIGS. 11A and 11B), results in a first draw force curve (or set of multiple draw force curves if multiple power module positions are available). Attachment of the power module 300*a* to the draw cable pulley 110*a* and the power module 300*b* to the draw cable pulley 110*b*, in the second power module orientations (face 320*a* facing draw cable pulley 110*a*, face 320*b* facing draw cable pulley 110*b*, power cable 31 taken up into groove 325*a*, and power cable 32 taken up into groove 325*b*; as in FIGS. 12A and 12B), results in a second draw force curve that differs from the first (or second set of multiple draw force curves if multiple power module positions are available).

In a dual cam bow (FIG. 1) or a binary cam bow (FIG. 2), wherein the two pulley assemblies 100 and 200 are employed that are mirror images of each other, two additional arrangements are available, resulting in two more different draw force curves (or two more sets of draw force curves if multiple power module positions are available). The dual-groove power modules 300*a* and 300*b* can be swapped between the pulley assemblies 100 and 200. Attachment of the power module 300*a* to the draw cable pulley 110*b* and the power module 300*b* to the draw cable pulley 110*a*, in the first power module orientations (face 310*a* facing draw cable pulley 110*b*, face 310*b* facing draw cable pulley 110*a*, power cable 32 taken up into groove 315*a*, and power cable 31 taken up into groove 315*b*; as in FIGS. 13A and 13B), results in a third differing draw force curve (or third set of multiple draw force curves if multiple power module positions are available). Attachment of the power module 300*a* to the draw cable pulley 110*b* and the power module 300*b* to the draw cable pulley 110*a*, in the second power module orientations (face 320*a* facing draw cable pulley 110*b*, face 320*b* facing draw cable pulley 110*a*, power cable 32 taken up into groove 325*a*, and power cable 31 taken up into groove 325*b*; as in FIGS. 14A and 14B), results in a fourth differing draw force curve (or fourth set of multiple draw force curves if multiple power module positions are available). The four differing draw force curves (or four sets of draw force curves, if multiple power module positions are available) can be varied in any suitable or desirable way, including varying one or more of the draw weight, the draw length, or the stored energy. It may be desirable in some examples arrange the power grooves 315*a*/315*b* and 325*a*/325*b* so as to enable alteration of the stored energy without altering the draw length or the draw weight.

In dual cam or binary cam examples wherein the grooves 315*a* and 325*a* of the first dual-groove power module 300*a*, and the grooves 315*b* and 325*b* of the second dual-groove power module 300*b*, serve as the sole power cable take-up pulley member, swapping the dual-groove power modules 300*a*/300*b* between the pulley assemblies 100/200 results in the power cables 31 and 32 begin taken up into the grooves 315*a*/315*b* or 325*a*/325*b* (depending on the power module orientations) in opposite directions. That in turn results in differing draw force curves that are not entirely independent of one another, because altering the profile of one groove affects two corresponding draw force curves (or two sets of draw force curves). The four differing draw force curves (or four sets of draw force curves, if multiple power module positions are available) can be varied in any suitable or desirable way, including varying one or more of the draw weight, the draw length, or the stored energy. It may be desirable in some examples arrange the power grooves 315*a*/315*b* and 325*a*/325*b* so as to enable alteration of the stored energy without altering the draw length or the draw weight.

In dual cam or binary cam examples in which one or more structural elements of the draw cable pulleys 110*a* and 110*b* form a portion of composite power cable take-up pulley members (e.g., posts 119*a* and 119*b* in the example shown), swapping the dual-groove power modules 300*a*/300*b* between the pulley assemblies 100/200 results in the power cables 31 and 32 begin taken up into the grooves 315*a*/315*b* or 325*a*/325*b* (depending on the power module orientations) in opposite directions and typically also into different portions of the respective grooves (which can be distinct from each other or can overlap). An initial portion of the draw force curve remains unchanged among all the differing draw force curves, and results from the power cables 31 and 32 being taken up by the structural elements of the draw cable pulleys 110*a* and 110*b*, respectively, independently of the positions or orientations of the power modules 300*a*/300*b*. Latter portions of the four differing draw force curves (or sets of curves) arise from the power cables 31 and 32 being taken up by: (i) portion 317*a* of groove 315*a* and portion 317*b* of groove 315*b*, respectively (as in FIGS. 11A and 11B); (ii) portion 327*a* of groove 325*a* and portion 327*b* of groove 325*b*, respectively (as in FIGS. 12A and 12B); (iii) portion 317*b* of groove 315*b* and portion 317*a* of groove 315*a*, respectively (as in FIGS. 13A and 13B); and (iv) portion 327*b* of groove 325*b* and portion 327*a* of groove 325*a*, respectively (as in FIGS. 14A and 14B). The latter portions of the four differing draw force curves (or four sets of draw force curves, if multiple power module positions are available) can be varied in any suitable or desirable way, in many examples substantially independently of one another, including varying one or more of the draw weight, the draw length, or the stored energy. It may be desirable in some examples arrange the power grooves 315*a*/315*b* and 325*a*/325*b* so as to enable alteration of the stored energy without altering the draw length or the draw weight.

In certain examples of a binary cam bow, instead of a separate power cable let-out pulley 180, the grooves 315*a*/315*b* or 325*a*/325*b* can act as the power-cable let-out pulleys. In the arrangement of FIGS. 11A/11B, the power cable 31 could be let out from groove 325*b* and taken up by groove 315*a*, and power cable 32 could be let out from groove 325*a* and taken up by groove 315*b*. In the arrangement of FIGS. 12A/12B, the power cable 31 could be let out from groove 315*b* and taken up by groove 325*a*, and power cable 32 could be let out from groove 315*a* and taken up by groove 325*b*. In the arrangement of FIGS. 13A/13B, the power cable 31 could be let out from groove 325*a* and taken up by groove 315*b*, and power cable 32 could be let out from groove 325*b* and taken up by groove 315*a*. In the arrangement of FIGS. 14A/14B, the power cable 31 could be let out from groove 315*a* and taken up by groove 325*b*, and power cable 32 could be let out from groove 315*b* and taken up by groove 325*a*.

In any of the foregoing arrangements, the differing draw force curves can arise from the arrangement of the corresponding grooves 315/325 of the dual-groove power module 300 in any suitable way. The respective shapes or profiles of the grooves 315 and 325 can differ in any suitable or desirable way, or the grooves 315 and 325 can differ with respect to their positions relative to structural features of the power module 300 employed to attach it to the draw cable pulley 110 (e.g., holes 302 or pins 319/329), or the grooves 315 and 325 can differ in both of those ways.

The pulley assembly 100 can further comprise a rotation stop substantially rigidly attached to the draw cable pulley 110. The rotation stop can be substantially rigidly attached to the draw cable pulley 110 in any one of a set of multiple rotation stop positions. In the example shown the rotation stop can comprise a rigid post (typically cushioned or damped) attached to the draw cable pulley 110 (e.g., positioned in a selected one of the holes 124 on the draw cable pulley 110) so that it impedes further rotation of the pulley assembly 100 when the post comes into contact with the power cable 31. Other suitable mechanical arrangements for implementing a rotation stop (e.g., a post arranged to collide with the bow limb 11) can be employed within the scope of the present disclosure or appended claims. Each rotation stop position (e.g., each one of the holes 124) corresponds to the draw length resulting from a corresponding position and orientation of the dual-groove power module 300 on the draw cable pulley 110. A method for adjusting the pulley assembly 100 therefore comprises, after securing the dual-groove power module 300 to the draw cable pulley 110 at a selected position and in a selected one of the two power module orientations to select the draw length of the bow, substantially rigidly attaching the rotation stop to the draw cable pulley 110 in a corresponding one of the multiple rotation stop positions that corresponds to the selected draw length. In examples wherein the dual-groove power module 300 can be moved only among a set of discrete positions, the set of multiple rotation stop positions also can comprise a set of discrete positions. In the examples shown, multiple threaded holes 124 formed in the draw cable pulley 110 are positioned at each desired rotation stop position.

As noted above, the disclosed inventive pulley assemblies can be employed with any type of compound archery bow, including dual cam, binary cam, solo cam, and hybrid cam bows. In dual or binary cam bows (FIGS. 1 and 2, respectively), the second pulley assembly 200 (rotatably mounted on limb 12) is a replica or, more typically, a mirror image of the first pulley assembly 100 already described. The power cable 32 is taken up by the power cable take-up groove of the second pulley assembly 200 as the bow is drawn and the second pulley assembly 200 rotates about a corresponding second pulley assembly axis. The power module of the second pulley assembly 200 can be adjusted in the same ways and with the same effect as disclosed above for the first pulley assembly 100. If the bow is a binary cam bow (FIG. 2), the pulley assemblies 100 and 200 each can resemble, e.g., the example of FIGS. 2, 5A through 8B, and 11A through 14B. If the bow is a dual cam bow (FIG. 1), the power cable let-out member 180 can be omitted and the power cables 31/32 can be attached (directly or indirectly) to the corresponding bow limbs.

If the bow is a solo cam bow (FIG. 3) or a hybrid cam bow (FIG. 4), the pulley assembly 100 can further include a let-out pulley 190 substantially rigidly coupled to the draw cable pulley 110 or (less commonly) the dual-groove power module 300; the power cable let-out member 180 can be omitted. The let-out pulley 190 is structurally arranged to receive a second end of the draw cable 30 (in a solo cam bow) or the additional coupling cable 33 (in a hybrid cam bow) in a circumferential draw cable groove and let out the draw cable 30 or the coupling cable 33.

Some examples of arrangements suitable for dual, binary, solo, or hybrid cam bows are disclosed in U.S. Pat. Nos. 7,305,979; 7,770,568; 8,181,638; 8,469,013; and 8,739,769. Each of those patents is incorporated by reference as if fully set forth herein.

In addition to the preceding, the following examples fall within the scope of the present disclosure or appended claims:

Example 1

A first pulley assembly for a compound archery bow, the first pulley assembly comprising a draw cable pulley and a dual-groove power module substantially rigidly attached to the draw cable pulley, wherein: (a) the draw cable pulley is structurally arranged so as to (i) define a first pulley assembly transverse rotation axis, (ii) be mounted on a first limb of an archery bow to rotate about the first pulley assembly axis, (iii) receive a first end of a draw cable of the bow in a circumferential draw cable groove of the draw cable pulley, and (iv) let out the first end of the draw cable from the draw cable groove when the bow is drawn and the draw cable pulley rotates about the first pulley assembly axis; (b) one or both of the draw cable pulley and the dual-groove power module are structurally arranged so as to enable substantially rigid, removable attachment of the dual-groove power module to the draw cable pulley in any one of one or more power module positions and, for each power module position, in any one of first or second power module orientations; (c) the dual-groove power module has opposite first and second faces, a first circumferential power cable groove adjacent the first face, and a second circumferential power cable groove adjacent the second face; (d) the dual-groove power module is structurally arranged, when attached to the draw cable pulley in the first power module orientation with the first face facing the draw cable pulley, so as to (i) receive a power cable of the bow in the first circumferential power cable groove, and (ii) take up the power cable into the first power cable groove when the bow is drawn and the draw cable pulley rotates about the first pulley assembly axis; (e) the dual-groove power module is structurally arranged, when attached to the draw cable pulley in the second power module orientation with the second face facing the draw cable pulley, so as to (i) receive the power cable of the bow in the second circumferential power cable groove, and (ii) take up the power cable into the second power cable groove when the bow is drawn and the draw cable pulley rotates about the first pulley assembly axis; and (f) for each one of the one or more power module positions, the first and second power module orientations result in corresponding draw force curves of the bow that differ substantially from each other.

Example 2

The pulley assembly of Example 1 wherein, for each one of the one or more power module positions, the first and second power module orientations result in corresponding draw lengths that do not differ substantially from each other, corresponding draw weights that do not differ substantially from each other, and corresponding stored energies of the drawn bow that differ substantially from each other.

Example 3

The pulley assembly of any one of Examples 1 or 2 wherein: (b') one or both of the draw cable pulley and the dual-groove power module are structurally arranged so as to enable substantially rigid, removable attachment of the dual-groove power module to the draw cable pulley in any one of multiple power module positions; (d') the dual-groove power module is structurally arranged, when attached to the draw cable pulley in the first power module orientation, so that each one of the multiple power module positions results in a corresponding draw force curve of the bow that differs substantially from a draw force curve corresponding to at least one other of the multiple power module positions; and (e') the dual-groove power module is structurally arranged, when attached to the draw cable pulley in the second power module orientation, so that each one of the multiple power module positions results in a corresponding draw force curve of the bow that differs substantially from a draw force curve corresponding to at least one other of the multiple power module positions.

Example 4

The pulley assembly of Example 3 further comprising a mounting member, wherein (i) one or both of the mounting member and the draw cable pulley are structurally arranged so as to enable substantially rigid, removable attachment of the mounting member to the draw cable pulley in any one of multiple mounting member positions, (ii) one or both of the mounting member and the dual-groove power module are structurally arranged so as to enable substantially rigid, removable attachment of the dual-groove power module to the mounting member in any one of the first or second power module orientations and in any one of the multiple power module positions, and (iii) attachment of the dual-groove power module to the mounting member and attachment of the mounting member to the power cable pulley provides the substantially rigid, removable attachment of the dual-groove power module to the draw cable pulley.

Example 5

The pulley assembly of any one of Examples 3 or 4 wherein, for each one of the first and second power module orientations, the multiple power module positions comprise a set of discrete positions of the dual-groove power module on the draw cable pulley.

Example 6

The pulley assembly of Example 5 wherein one or both of the draw cable pulley and the dual-groove power module are structurally arranged so as to engage each other, in each one of the first and second power module orientations, to mechanically index each one of the discrete positions of the dual-groove power module on the draw cable pulley.

Example 7

The pulley assembly of any one of Examples 5 or 6 further comprising a rotation stop substantially rigidly attached to the draw cable pulley, wherein (i) one or both of the draw cable pulley and the rotation stop are structurally arranged so as to enable substantially rigid attachment of the rotation stop to the draw cable pulley in any one of multiple discrete rotation stop positions, and (ii) each one of the discrete rotation stop positions corresponds to a draw length resulting from the first or second power module orientation and one of the discrete power module positions.

Example 8

A method for adjusting the pulley assembly of any one of Examples 3 through 7, the method comprising: (A) removing the dual-groove power module from one of the multiple power module positions and one of the first or second power module orientations on the draw cable pulley; and (B) reattaching the dual-groove power module to the draw cable pulley in a different one of the multiple power module positions and in the same one of the first or second power module orientations, (C) thereby substantially altering one or more of stored energy of the drawn bow, draw length of the bow, or draw weight of the bow.

Example 9

The pulley assembly of any one of Examples 1 through 7 further comprising a rotation stop substantially rigidly attached to the draw cable pulley, wherein one or both of the draw cable pulley and the rotation stop are structurally arranged so as to enable substantially rigid attachment of the rotation stop to the draw cable pulley in any one of multiple rotation stop positions, each rotation stop position corresponding to a draw length resulting from the first or second power module orientation and one of the one or more power module positions.

Example 10

The pulley assembly of Example 9 wherein: the multiple power module positions comprise a set of discrete positions of the power module on the draw cable pulley; the multiple rotation stop positions comprise a set of discrete positions; and each one of the discrete rotation stop positions corresponds to one of the discrete power module positions.

Example 11

A method for adjusting the pulley assembly of any one of Examples 9 or 10, the method comprising: (A) removing the dual-groove power module from one of the multiple power module positions and one of the first or second power module orientations on the draw cable pulley; (B) reattaching the dual-groove power module to the draw cable pulley in a different one of the multiple power module positions or in a different one of the first or second power module orientations, so as to alter the draw length of the bow; and (C) moving the rotation stop from a first one of the multiple rotation stop positions and substantially rigidly attaching the rotation stop to the draw cable pulley in a second, different one of the multiple rotation stop positions that corresponds to the altered draw length of the bow.

Example 12

The pulley assembly of any one of Examples 1 through 7, 9, or 10 wherein the pulley assembly further comprises a cable let-out pulley substantially rigidly attached to the draw cable pulley or the dual-groove power module, wherein the cable let-out pulley is structurally arranged so as to (i)

receive an additional cable of the bow in a circumferential cable groove of the cable let-out pulley, and (ii) let out the additional cable from the cable groove when the bow is drawn and the draw cable pulley rotates about the first pulley assembly axis.

Example 13

A method for adjusting the pulley assembly of any one of Examples 1 through 7, 9, 10, or 12, the method comprising: (A) removing the dual-groove power module from one of the one or more power module positions and one of the first or second power module orientations on the draw cable pulley; and (B) reattaching the dual-groove power module to the draw cable pulley in the same one of the one or more power module positions and in a different one of the first or second power module orientations, (C) thereby substantially altering one or more of stored energy of the drawn bow, draw length of the bow, or draw weight of the bow.

Example 14

The pulley assembly of any one of Examples 1 through 7, 9, 10, 12, or 13 further comprising a second pulley assembly for the compound archery bow that is a mirror image of the first pulley assembly, the second pulley assembly comprising a second draw cable pulley and a second dual-groove power module substantially rigidly attached to the second draw cable pulley, wherein: (a') the second draw cable pulley is structurally arranged so as to (i) define a second pulley assembly transverse rotation axis substantially parallel to the first pulley assembly axis, (ii) be mounted on a second limb of the archery bow to rotate about the second pulley assembly axis, (iii) receive a second end of the draw cable of the bow in a circumferential draw cable groove of the second draw cable pulley, and (iv) let out the second end of the draw cable from the draw cable groove when the bow is drawn and the second draw cable pulley rotates about the second pulley assembly axis; (b') one or both of the second draw cable pulley and the second dual-groove power module are structurally arranged so as to enable substantially rigid, removable attachment of the second dual-groove power module to the second draw cable pulley in any one of one or more second power module positions and, for each second power module position, in any one of first or second second power module orientations; (c') the second dual-groove power module has opposite first and second faces, a first circumferential power cable groove adjacent the first face, and a second circumferential power cable groove adjacent the second face; (d') the second dual-groove power module is structurally arranged, when attached to the second draw cable pulley in the first second power module orientation with the first face facing the second draw cable pulley, so as to (i) receive a second power cable of the bow in a first circumferential power cable groove of the second dual-groove power module, and (ii) take up the second power cable into the first power cable groove when the bow is drawn and the second draw cable pulley rotates about the second pulley assembly axis; (e') the second dual-groove power module is structurally arranged, when attached to the second draw cable pulley in the second second power module orientation with the second face facing the second draw cable pulley, so as to (i) receive the second power cable of the bow in a second circumferential power cable groove of the second dual-groove power module, and (ii) take up the second power cable into the second power cable groove when the bow is drawn and the second draw cable pulley rotates about the second pulley assembly axis; and (f') for each one of the one or more second power module positions, the first and second second power module orientations result in corresponding draw force curves of the bow that differ substantially from each other.

Example 15

The pulley assemblies of Example 14 wherein, for each one of the one or more second power module positions, the first and second power module orientations result in corresponding draw lengths that do not differ substantially from each other, corresponding draw weights that do not differ substantially from each other, and corresponding stored energies of the drawn bow that differ substantially from each other.

Example 16

A method for adjusting the pulley assemblies of any one of Examples 14 or 15, the method comprising: (A) removing the dual-groove power module from one of the one or more power module positions and one of the first or second power module orientations on the draw cable pulley; (A') removing the second dual-groove power module from one of the one or more second power module positions and one of the first or second second power module orientations on the second draw cable pulley; (B) attaching the dual-groove power module to the second draw cable pulley in the same one of the one or more second power module positions and in the same one of the first or second power module orientations; and (B') attaching the second dual-groove power module to the draw cable pulley in the same one of the one or more power module positions and in the same one of the first or second second power module orientations, (C) thereby altering one or more of stored energy of the drawn bow, draw length of the bow, or draw weight of the bow.

Example 17

A compound archery bow, comprising: (a) a central riser; (b) first and second bow limbs secured to opposing ends of the riser; (c) a first pulley assembly rotatably mounted on the first bow limb; (d) either an idler wheel or a second pulley assembly rotatably mounted on the second bow limb; (e) a draw cable; and (f) a power cable, wherein: (g) the first pulley assembly comprises a draw cable pulley and a dual-groove power module substantially rigidly attached to the draw cable pulley; (h) the draw cable pulley is structurally arranged so as to (i) define a first pulley assembly transverse rotation axis, (ii) be mounted on the first limb of the bow to rotate about the first pulley assembly axis, (iii) receive a first end of the draw cable in a circumferential draw cable groove of the draw cable pulley, and (iv) let out the first end of the draw cable from the draw cable groove when the bow is drawn and the draw cable pulley rotates about the first pulley assembly axis; (i) one or both of the draw cable pulley and the dual-groove power module are structurally arranged so as to enable substantially rigid, removable attachment of the dual-groove power module to the draw cable pulley in any one of one or more power module positions and, for each power module position, in any one of first or second power module orientations; (j) the dual-groove power module has opposite first and second faces, a first circumferential power cable groove adjacent the first face, and a second circumferential power cable groove adjacent the second face; (k) the dual-groove power module is structurally arranged, when attached to the draw cable pulley in the first power module orientation with the first face facing the draw cable pulley, so as to (i) receive the power cable in a first circumferential power cable groove of the dual-groove power module, and (ii) take up the power cable into the first power cable groove when the bow is drawn and the draw cable pulley rotates about the first pulley assembly axis; (e) the dual-groove power module is structurally arranged, when attached to the draw cable pulley in the second power module orientation with the second face facing the draw cable pulley, so as to (i) receive the power cable of the bow in a second circumferential power cable groove of the dual-groove power module, and (ii) take up the power cable into the second power cable groove when the bow is drawn and the draw cable pulley rotates about the first pulley assembly axis; and (m) for each one of the one or more power module positions, the first and second power module orientations result in corresponding draw force curves of the bow that differ substantially from each other.

Example 18

The compound archery bow of Example 17 wherein, for each one of the one or more power module positions, the first and second power module orientations result in corresponding draw lengths that do not differ substantially from each other, corresponding draw weights that do not differ substantially from each other, and corresponding stored energies of the drawn bow that differ substantially from each other.

Example 19

The compound archery bow of any one of Examples 17 or 18 wherein: (b') one or both of the draw cable pulley and the dual-groove power module are structurally arranged so as to enable substantially rigid, removable attachment of the dual-groove power module to the draw cable pulley in any one of multiple power module positions; (c') the dual-groove power module is structurally arranged, when attached to the draw cable pulley in the first power module orientation, so that each one of the multiple power module positions results in a corresponding draw force curve of the bow that differs from a draw force curve corresponding to at least one other of the multiple power module positions; and (d') the dual-groove power module is structurally arranged, when attached to the draw cable pulley in the second power module orientation, so that each one of the multiple power module positions results in a corresponding draw force curve of the bow that differs from a draw force curve corresponding to at least one other of the multiple power module positions.

Example 20

The compound archery bow of any one of Examples 17 through 19 wherein (i) the first pulley assembly further comprises a mounting member, (i) one or both of the mounting member and the draw cable pulley are structurally arranged so as to enable substantially rigid, removable attachment of the mounting member to the draw cable pulley in any one of multiple mounting member positions, (ii) one or both of the mounting member and the dual-groove power module are structurally arranged so as to enable substantially rigid, removable attachment of the dual-groove power module to the mounting member in any one of the first or second power module orientations and in any one of the one or more power module positions, and (iii) attachment of the dual-groove power module to the mounting member and attachment of the mounting member to the power cable pulley provide the substantially rigid, removable attachment of the dual-groove power module to the draw cable pulley.

Example 21

The compound archery bow of any one of Examples 19 or 20 wherein, for each one of the first and second power module orientations, the multiple power module positions comprise a set of discrete positions of the dual-groove power module on the draw cable pulley.

Example 22

The compound archery bow of Example 21 wherein one or both of the draw cable pulley and the dual-groove power module are structurally arranged so as to engage each other, in each one of the first and second power module orientations, to mechanically index each one of the discrete positions of the power module on the draw cable pulley.

Example 23

The compound archery bow of any one of Examples 21 or 22 further comprising a rotation stop substantially rigidly attached to the draw cable pulley, wherein (i) one or both of the draw cable pulley and the rotation stop are structurally arranged so as to enable substantially rigid attachment of the rotation stop to the draw cable pulley in any one of multiple discrete rotation stop positions, and (ii) each one of the discrete rotation stop positions corresponds to a draw length resulting from the first or second power module orientation and one of the discrete power module positions.

Example 24

A method for adjusting the compound archery bow of any one of Examples 19 through 23, the method comprising: (A) removing the dual-groove power module from one of the multiple power module positions and one of the first or second power module orientations on the draw cable pulley; and (B) reattaching the dual-groove power module to the draw cable pulley in a different one of the multiple power module positions and in the same one of the first or second power module orientations, (C) thereby altering one or more of stored energy of the drawn bow, draw length of the bow, or draw weight of the bow.

Example 25

The compound archery bow of any one of Examples 17 through 23 further comprising a rotation stop substantially rigidly attached to the draw cable pulley, wherein one or both of the draw cable pulley and the rotation stop are structurally arranged so as to enable substantially rigid attachment of the rotation stop to the draw cable pulley in any one of multiple rotation stop positions, each rotation stop position corresponding to a draw length resulting from the first or second power module orientation and one of the one or more power module positions.

Example 26

The compound archery bow of Example 25 wherein: the multiple power module positions comprise a set of discrete positions of the power module on the draw cable pulley; the multiple rotation stop positions comprise a set of discrete positions; and each one of the discrete rotation stop positions corresponds to one of the discrete power module positions.

Example 27

A method for adjusting the compound archery bow of any one of Examples 25 or 26 the method comprising: (A) removing the dual-groove power module from one of the multiple power module positions and one of the first or second power module orientations on the draw cable pulley; (B) reattaching the dual-groove power module to the draw cable pulley in a different one of the multiple power module positions or in a different one of the first or second power module orientations, so as to alter the draw length of the bow; and (C) moving the rotation stop from a first one of the multiple rotation stop positions and substantially rigidly attaching the rotation stop to the draw cable pulley in a second, different one of the multiple rotation stop positions that corresponds to the altered draw length of the bow.

Example 28

The compound archery bow of any one of Examples 17 through 23, 25, or 26 further comprising the second pulley assembly, wherein the second pulley assembly includes a power cable let-out pulley that is structurally arranged so as to (i) receive the power cable in a circumferential power cable groove of the power cable let-out pulley, and (ii) let out the power cable from the power cable groove when the bow is drawn and the second pulley assembly rotates about a second pulley assembly axis.

Example 29

The compound archery bow of any one of Examples 17 through 23, 25, or 26 further comprising the idler wheel, wherein: (n) the first pulley assembly further comprises a draw cable let-out pulley substantially rigidly attached to the first draw cable pulley or the dual-groove power module; and (o) the draw cable let-out pulley is structurally arranged so as to (i) receive a second end of the draw cable in a circumferential draw cable groove of the draw cable let-out pulley, and (ii) let out the second end of the draw cable from the draw cable groove, with the draw cable passing around the idler wheel, when the bow is drawn and the draw cable pulley rotates about the first pulley assembly axis.

Example 30

The compound archery bow of any one of Examples 17 through 23, 25, 26, or 28 further comprising the second pulley assembly and a coupling cable, wherein: (n) the first pulley assembly further comprises a coupling cable let-out pulley substantially rigidly attached to the draw cable pulley or the dual-groove power module; (o) the second pulley assembly comprises a second draw cable pulley and a coupling cable take-up pulley; (p) the second draw cable pulley is structurally arranged so as to (i) receive a second end of the draw cable in a circumferential draw cable groove of the second draw cable pulley, and (ii) let out the second end of the draw cable from the draw cable groove when the bow is drawn and the second pulley assembly rotates about the second pulley assembly axis; (q) the coupling cable take-up pulley is structurally arranged so as to (i) receive a first end of the coupling cable in a circumferential coupling cable groove of the coupling cable take-up pulley, and (ii) take up the first end of the coupling cable into the coupling cable groove when the bow is drawn and the second pulley assembly rotates about the second pulley assembly axis; and (r) the coupling cable let-out pulley is structurally arranged so as to (i) receive a second end of the coupling cable in a circumferential coupling cable groove of the coupling cable let-out pulley, and (ii) let out the second end of the coupling cable from the coupling cable groove when the bow is drawn and the first pulley assembly rotates about the first pulley assembly axis.

Example 31

A method for adjusting the compound archery bow of any one of Examples 17 through 23, 25, 26, or 28 through 30, the method comprising:
(A) removing the dual-groove power module from one of the one or more power module positions and one of the first or second power module orientations on the draw cable pulley; and (B) reattaching the dual-groove power module to the draw cable pulley in the same one of the one or more power module positions and in a different one of the two power module orientations, (C) thereby altering one or more of stored energy of the drawn bow, draw length of the bow, or draw weight of the bow.

Example 32

A compound archery bow, comprising: (a) a central riser; (b) first and second bow limbs secured to opposing ends of the riser; (c) a first draw cable pulley rotatably mounted on the first bow limb; (d) a second draw cable pulley that is a mirror image of the first draw cable pulley and is rotatably mounted on the second bow limb; (e) first and second dual-groove power modules that are mirror images of each other; and (f) a draw cable and two power cables, wherein: (g) each one of the first and second draw cable pulleys is structurally arranged so as to (i) define a corresponding pulley assembly transverse rotation axis, (ii) be mounted on the corresponding limb of the bow to rotate about the corresponding pulley assembly axis, (iii) receive a corresponding end of the draw cable in a corresponding circumferential draw cable groove, and (iv) let out the corresponding end of the draw cable from the corresponding draw cable groove when the bow is drawn and the first and second draw cable pulleys rotate about the corresponding pulley assembly axes; (h) the first and second draw cable pulleys, the first and second dual-groove power modules, or both are structurally arranged so as to enable (i) substantially rigid, removable attachment of one of the first or second dual-groove power modules to the first draw cable pulley in any one of one or more first pulley assembly power module positions and, for each first pulley assembly power module position, in any one of first or second first pulley assembly power module orientations, and (ii) substantially rigid, removable attachment of the other of the first or second power modules to the second draw cable pulley in a corresponding one of one or more second pulley assembly power module positions and, for each second pulley assembly power module position, in any one of first or second second pulley assembly power module orientations; (i) each one of the first and second dual-groove power modules has opposite first and second faces, a first circumferential power cable groove adjacent the first face, and a second circumferential power cable groove adjacent the second face; (j) each one of the first and second power modules is structurally arranged, when substantially rigidly attached to a corresponding one of the first or second draw cable pulleys with the corresponding first face facing the corresponding draw cable pulley, so as to (i) receive a first end of a corresponding one of the power cables in the first circumferential power cable groove of that power module, and (ii) take up the corresponding power cable into the corresponding first power cable groove when the bow is drawn and the first and second draw cable pulleys rotate about the corresponding pulley assembly axes; and (k) each one of the first and second power modules is structurally arranged, when substantially rigidly attached to a corresponding one of the first or second draw cable pulleys with the corresponding second face facing the corresponding draw cable pulley, so as to (i) receive a first end a corresponding one of the power cables in the second circumferential power cable groove of that power module, and (ii) take up the corresponding power cable into the corresponding second power cable groove when the bow is drawn and the first and second draw cable pulleys rotate about the corresponding pulley assembly axes.

Example 33

The compound archery bow of Example 32 wherein, for each one of the one or more first and second pulley assembly power module positions, the first and second pulley assembly first and second power module orientations result in corresponding draw lengths that do not differ substantially from each other, corresponding draw weights that do not differ substantially from each other, and corresponding stored energies of the drawn bow that differ substantially from each other.

Example 34

The compound archery bow of any one of Examples 32 or 33 wherein: (n) the first pulley assembly further comprises a first power cable let-out pulley substantially rigidly attached to the draw cable pulley or the dual-groove power module; (o) the first power cable let-out pulley is structurally arranged so as to (i) receive a second end of the second power cable of the bow in a circumferential power cable groove of the first power cable let-out pulley, and (ii) let out the second power cable from the power cable groove when the bow is drawn and the draw cable pulley rotates about the first pulley assembly axis; (p) the second pulley assembly further comprises a second power cable let-out pulley substantially rigidly attached to the second draw cable pulley or the second dual-groove power module; and (q) the second power cable let-out pulley is structurally arranged so as to (i) receive a second end of the first power cable of the bow in a circumferential power cable groove of the second power cable let-out pulley, and (ii) let out the first power cable from the power cable groove when the bow is drawn and the second draw cable pulley rotates about the second pulley assembly axis.

Example 35

The compound archery bow of any one of Examples 32 or 33 wherein: (n) each one of the first and second power modules is structurally arranged, when substantially rigidly attached to a corresponding one of the first or second draw cable pulleys with the corresponding first face facing the corresponding draw cable pulley, so as to (i) receive a second end of a corresponding one of the power cables in the second circumferential power cable groove of that power module, and (ii) let out the corresponding power cable from the corresponding second power cable groove when the bow is drawn and the first and second draw cable pulleys rotate about the corresponding pulley assembly axes; and (o) each one of the first and second power modules is structurally arranged, when substantially rigidly attached to a corresponding one of the first or second draw cable pulleys with the corresponding second face facing the corresponding draw cable pulley, so as to (i) receive a second end of a corresponding one of the power cables in the first circumferential power cable groove of that power module, and (ii) let out the corresponding power cable from the corresponding first power cable groove when the bow is drawn and the first and second draw cable pulleys rotate about the corresponding pulley assembly axes.

Example 36

The compound archery bow of any one of Examples 32 through 35 wherein one or both of the first or second draw cable pulleys or one or both of the first or second dual-groove power modules is arranged or can be adjusted according to any one of Examples 1 through 31.

Example 37

A method for adjusting the compound archery bow of any one of Examples 32 through 36, the method comprising: (A) removing the first dual-groove power module from one of the one or more first pulley assembly power module positions and one of the first or second first pulley assembly power module orientations on the first draw cable pulley; (B) removing the second dual-groove power module from a corresponding one of the one or more second pulley assembly power module positions and a corresponding one of the first or second second power module orientations on the second draw cable pulley; (C) attaching the first dual-groove power module to the first draw cable pulley in a different one of the one or more first pulley assembly power module positions or a different one of the first or second first pulley assembly power module orientations on the first draw cable pulley; and (D) attaching the second dual-groove power module to the second draw cable pulley in a corresponding different one of the one or more second pulley assembly power module positions or a corresponding different one of the first or second second pulley assembly power module orientations on the second draw cable pulley, (E) thereby altering one or more of stored energy of the drawn bow, draw length of the bow, or draw weight of the bow.

Example 38

A method for adjusting the compound archery bow of any one of Examples 32 through 36, the method comprising: (A) removing the first dual-groove power module from one of the one or more first pulley assembly power module positions and one of the first or second first pulley assembly power module orientations on the first draw cable pulley; (B) removing the second dual-groove power module from a corresponding one of the one or more second pulley assembly power module positions and a corresponding one of the first or second second pulley assembly power module orientations on the second draw cable pulley; (C) attaching the first dual-groove power module to the first draw cable pulley in a different one of the one or more first pulley assembly power module positions and the same one of the first or second first pulley assembly power module orientations on the first draw cable pulley; and (D) attaching the second dual-groove power module to the second draw cable pulley in a corresponding different one of the one or more second pulley assembly power module positions and the same one of the first or second second pulley assembly power module orientations on the second draw cable pulley, (E) thereby altering one or more of stored energy of the drawn bow, draw length of the bow, or draw weight of the bow.

Example 39

A method for adjusting the compound archery bow of any one of Examples 32 through 36, the method comprising: (A) removing the first dual-groove power module from one of the one or more first pulley assembly power module positions and one of the first or second first pulley assembly power module orientations on the first draw cable pulley; (B) removing the second dual-groove power module from a corresponding one of the one or more second pulley assembly power module positions and a corresponding one of the first or second second pulley assembly power module orientations on the second draw cable pulley; (C) attaching the first dual-groove power module to the first draw cable pulley in the same one of the one or more first pulley assembly power module positions and a different one of the first or second first pulley assembly power module orientations on the first draw cable pulley; and (D) attaching the second dual-groove power module to the second draw cable pulley in the same one of the one or more second pulley assembly power module positions and a different one of the first or second second pulley assembly power module orientations on the second draw cable pulley, (E) thereby altering one or more of stored energy of the drawn bow, draw length of the bow, or draw weight of the bow.

Example 40

A method for adjusting the compound archery bow of any one of Examples 32 through 36, the method comprising: (A) removing the first dual-groove power module from one of the one or more first pulley assembly power module positions and one of the first or second first pulley assembly power module orientations on the first draw cable pulley; (B) removing the second dual-groove power module from a corresponding one of the one or more second pulley assembly power module positions and a corresponding one of the first or second second pulley assembly power module orientations on the second draw cable pulley; (C) attaching the second dual-groove power module to the first draw cable pulley in one of the one or more first pulley assembly power module positions and one of the first or second first pulley assembly power module orientations on the first draw cable pulley; and (D) attaching the first dual-groove power module to the second draw cable pulley in a corresponding one of the one or more second pulley assembly power module positions and a corresponding one of the first or second second pulley assembly power module orientations on the second draw cable pulley, (E) thereby altering one or more of stored energy of the drawn bow, draw length of the bow, or draw weight of the bow.

Example 41

A method for adjusting the compound archery bow of any one of Examples 32 through 36, the method comprising: (A) removing the first dual-groove power module from one of the one or more first pulley assembly power module positions and one of the first or second first pulley assembly power module orientations on the first draw cable pulley; (B) removing the second dual-groove power module from a corresponding one of the one or more second pulley assembly power module positions and a corresponding one of the first or second second pulley assembly power module orientations on the second draw cable pulley; (C) attaching the second dual-groove power module to the first draw cable pulley in the same one of the one or more first pulley assembly power module positions and the same one of the first or second first pulley assembly power module orientations on the first draw cable pulley; and (D) attaching the first dual-groove power module to the second draw cable pulley in the corresponding same one of the one or more second pulley assembly power module positions and the corresponding same one of the first or second second pulley assembly power module orientations on the second draw cable pulley, (E) thereby altering one or more of stored energy of the drawn bow, draw length of the bow, or draw weight of the bow.

Example 42

A method for adjusting the compound archery bow of any one of Examples 32 through 36, the method comprising: (A) removing the first dual-groove power module from one of the one or more first pulley assembly power module positions and one of the first or second first pulley assembly power module orientations on the first draw cable pulley; (B) removing the second dual-groove power module from a corresponding one of the one or more second pulley assembly power module positions and a corresponding one of the first or second second pulley assembly power module orientations on the second draw cable pulley; (C) attaching the second dual-groove power module to the first draw cable pulley in the same one of the one or more first pulley assembly power module positions and a different one of the first or second first pulley assembly power module orientations on the first draw cable pulley; and (D) attaching the first dual-groove power module to the second draw cable pulley in the corresponding same one of the one or more second pulley assembly power module positions and a corresponding different one of the first or second second pulley assembly power module orientations on the second draw cable pulley, (E) thereby altering one or more of stored energy of the drawn bow, draw length of the bow, or draw weight of the bow.

It is intended that equivalents of the disclosed example embodiments and methods shall fall within the scope of the present disclosure or appended claims. It is intended that the disclosed example embodiments and methods, and equivalents thereof, may be modified while remaining within the scope of the present disclosure or appended claims.

In the foregoing Detailed Description, various features may be grouped together in several example embodiments for the purpose of streamlining the disclosure. This method of disclosure is not to be interpreted as reflecting an intention that any claimed embodiment requires more features than are expressly recited in the corresponding claim. Rather, as the appended claims reflect, inventive subject matter may lie in less than all features of a single disclosed example embodiment. Thus, the appended claims are hereby incorporated into the Detailed Description, with each claim standing on its own as a separate disclosed embodiment. However, the present disclosure shall also be construed as implicitly disclosing any embodiment having any suitable set of one or more disclosed or claimed features (i.e., a set of features that are neither incompatible nor mutually exclusive) that appear in the present disclosure or the appended claims, including those sets that may not be explicitly disclosed herein. In addition, for purposes of disclosure, each of the appended dependent claims shall be construed as if written in multiple dependent form and dependent upon all preceding claims with which it is not inconsistent. It should be further noted that the scope of the appended claims does not necessarily encompass the whole of the subject matter disclosed herein.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or," "only one of," or similar language; or (ii) two or more of the listed alternatives are mutually exclusive within the particular context, in which case "or" would encompass only those combinations involving non-mutually-exclusive alternatives. For purposes of the present disclosure and appended claims, the words "comprising," "including," "having," and variants thereof, wherever they appear, shall be construed as open ended terminology, with the same meaning as if the phrase "at least" were appended after each instance thereof, unless explicitly stated otherwise. For purposes of the present disclosure or appended claims, when terms are employed such as "about equal to," "substantially equal to," "greater than about," "less than about," and so forth, in relation to a numerical quantity, standard conventions pertaining to measurement precision and significant digits shall apply, unless a differing interpretation is explicitly set forth. For null quantities described by phrases such as "substantially prevented," "substantially absent," "substantially eliminated," "about equal to zero," "negligible," and so forth, each such phrase shall denote the case wherein the quantity in question has been reduced or diminished to such an extent that, for practical purposes in the context of the intended operation or use of the disclosed or claimed apparatus or method, the overall behavior or performance of the apparatus or method does not differ from that which would have occurred had the null quantity in fact been completely removed, exactly equal to zero, or otherwise exactly nulled.

In the appended claims, any labelling of elements, steps, limitations, or other portions of a claim (e.g., first, second, etc., (a), (b), (c), etc., or (i), (ii), (iii), etc.) is only for purposes of clarity, and shall not be construed as implying any sort of ordering or precedence of the claim portions so labelled. If any such ordering or precedence is intended, it will be explicitly recited in the claim or, in some instances, it will be implicit or inherent based on the specific content of the claim. In the appended claims, if the provisions of 35 USC §112(f) are desired to be invoked in an apparatus claim, then the word "means" will appear in that apparatus claim. If those provisions are desired to be invoked in a method claim, the words "a step for" will appear in that method claim. Conversely, if the words "means" or "a step for" do not appear in a claim, then the provisions of 35 USC §112(f) are not intended to be invoked for that claim.

If any one or more disclosures are incorporated herein by reference and such incorporated disclosures conflict in part or whole with, or differ in scope from, the present disclosure, then to the extent of conflict, broader disclosure, or broader definition of terms, the present disclosure controls. If such incorporated disclosures conflict in part or whole with one another, then to the extent of conflict, the later-dated disclosure controls.

The Abstract is provided as required as an aid to those searching for specific subject matter within the patent literature. However, the Abstract is not intended to imply that any elements, features, or limitations recited therein are necessarily encompassed by any particular claim. The scope of subject matter encompassed by each claim shall be determined by the recitation of only that claim.

What is claimed is:

1. A first pulley assembly for a compound archery bow, the first pulley assembly comprising a draw cable pulley and a dual-groove power module substantially rigidly attached to the draw cable pulley, wherein:

(a) the draw cable pulley is structurally arranged so as to (i) define a first pulley assembly transverse rotation axis, (ii) be mounted on a first limb of an archery bow to rotate about the first pulley assembly axis, (iii) receive a first end of a draw cable of the bow in a circumferential draw cable groove of the draw cable pulley, and (iv) let out the first end of the draw cable from the draw cable groove when the bow is drawn and the draw cable pulley rotates about the first pulley assembly axis;

(b) one or both of the draw cable pulley and the dual-groove power module are structurally arranged so as to enable substantially rigid, removable attachment of the dual-groove power module to the draw cable pulley in any one of one or more power module positions and, for each power module position, in any one of first or second power module orientations;

(c) the dual-groove power module has opposite first and second faces, a first circumferential power cable groove adjacent the first face, and a second circumferential power cable groove adjacent the second face;

(d) the dual-groove power module is structurally arranged, when attached to the draw cable pulley in the first power module orientation with the first face facing the draw cable pulley, so as to (i) receive a power cable of the bow in the first circumferential power cable groove, and (ii) take up the power cable into the first power cable groove when the bow is drawn and the draw cable pulley rotates about the first pulley assembly axis;

(e) the dual-groove power module is structurally arranged, when attached to the draw cable pulley in the second power module orientation with the second face facing the draw cable pulley, so as to (i) receive the power cable of the bow in the second circumferential power cable groove, and (ii) take up the power cable into the second power cable groove when the bow is drawn and the draw cable pulley rotates about the first pulley assembly axis; and (f) for each one of the one or more power module positions, the first and second power module orientations result in corresponding draw force curves of the bow that differ substantially from each other.

2. The pulley assembly of claim 1 wherein, for each one of the one or more power module positions, the first and second power module orientations result in corresponding draw lengths that do not differ substantially from each other, corresponding draw weights that do not differ substantially from each other, and corresponding stored energies of the drawn bow that differ substantially from each other.

3. A method for adjusting the pulley assembly of claim 1, the method comprising:

(A) removing the dual-groove power module from one of the one or more power module positions and one of the first or second power module orientations on the draw cable pulley; and (B) reattaching the dual-groove power module to the draw cable pulley in the same one of the one or more power module positions and in a different one of the first or second power module orientations, (C) thereby substantially altering one or more of stored energy of the drawn bow, draw length of the bow, or draw weight of the bow.

4. The pulley assembly of claim 1 wherein:

(b') one or both of the draw cable pulley and the dual-groove power module are structurally arranged so as to enable substantially rigid, removable attachment of the dual-groove power module to the draw cable pulley in any one of multiple power module positions;

(d') the dual-groove power module is structurally arranged, when attached to the draw cable pulley in the first power module orientation, so that each one of the multiple power module positions results in a corresponding draw force curve of the bow that differs substantially from a draw force curve corresponding to at least one other of the multiple power module positions; and (e') the dual-groove power module is structurally arranged, when attached to the draw cable pulley in the second power module orientation, so that each one of the multiple power module positions results in a corresponding draw force curve of the bow that differs substantially from a draw force curve corresponding to at least one other of the multiple power module positions.

5. A method for adjusting the pulley assembly of claim 4, the method comprising:

(A) removing the dual-groove power module from one of the multiple power module positions and one of the first or second power module orientations on the draw cable pulley; and (B) reattaching the dual-groove power module to the draw cable pulley in a different one of the multiple power module positions and in the same one of the first or second power module orientations, (C) thereby substantially altering one or more of stored energy of the drawn bow, draw length of the bow, or draw weight of the bow.

6. The pulley assembly of claim 4 further comprising a mounting member, wherein (i) one or both of the mounting member and the draw cable pulley are structurally arranged so as to enable substantially rigid, removable attachment of the mounting member to the draw cable pulley in any one of multiple mounting member positions, (ii) one or both of the mounting member and the dual-groove power module are structurally arranged so as to enable substantially rigid, removable attachment of the dual-groove power module to the mounting member in any one of the first or second power module orientations and in any one of the multiple power module positions, and (iii) attachment of the dual-groove power module to the mounting member and attachment of the mounting member to the power cable pulley provides the substantially rigid, removable attachment of the dual-groove power module to the draw cable pulley.

7. The pulley assembly of claim 1 further comprising a rotation stop substantially rigidly attached to the draw cable pulley, wherein one or both of the draw cable pulley and the rotation stop are structurally arranged so as to enable substantially rigid attachment of the rotation stop to the draw cable pulley in any one of multiple rotation stop positions, each rotation stop position corresponding to a draw length resulting from the first or second power module orientation and one of the one or more power module positions.

8. A method for adjusting the pulley assembly of claim 7, the method comprising:

(A) removing the dual-groove power module from one of the multiple power module positions and one of the first or second power module orientations on the draw cable pulley;

(B) reattaching the dual-groove power module to the draw cable pulley in a different one of the multiple power module positions or in a different one of the first or second power module orientations, so as to alter the draw length of the bow; and (C) moving the rotation stop from a first one of the multiple rotation stop positions and substantially rigidly attaching the rotation stop to the draw cable pulley in a second, different one of the multiple rotation stop positions that corresponds to the altered draw length of the bow.

9. The pulley assembly of claim 1 wherein the pulley assembly further comprises a cable let-out pulley substantially rigidly attached to the draw cable pulley or the dual-groove power module, wherein the cable let-out pulley is structurally arranged so as to (i) receive an additional cable of the bow in a circumferential cable groove of the cable let-out pulley, and (ii) let out the additional cable from the cable groove when the bow is drawn and the draw cable pulley rotates about the first pulley assembly axis.

10. The pulley assembly of claim 1 further comprising a second pulley assembly for the compound archery bow that is a mirror image of the first pulley assembly, the second pulley assembly comprising a second draw cable pulley and a second dual-groove power module substantially rigidly attached to the second draw cable pulley, wherein:

(a') the second draw cable pulley is structurally arranged so as to (i) define a second pulley assembly transverse rotation axis substantially parallel to the first pulley assembly axis, (ii) be mounted on a second limb of the archery bow to rotate about the second pulley assembly axis, (iii) receive a second end of the draw cable of the bow in a circumferential draw cable groove of the second draw cable pulley, and (iv) let out the second end of the draw cable from the draw cable groove when the bow is drawn and the second draw cable pulley rotates about the second pulley assembly axis;

(b') one or both of the second draw cable pulley and the second dual-groove power module are structurally arranged so as to enable substantially rigid, removable attachment of the second dual-groove power module to the second draw cable pulley in any one of one or more second power module positions and, for each second power module position, in any one of first or second second power module orientations;

(c') the second dual-groove power module has opposite first and second faces, a first circumferential power cable groove adjacent the first face, and a second circumferential power cable groove adjacent the second face;

(d') the second dual-groove power module is structurally arranged, when attached to the second draw cable pulley in the first second power module orientation with the first face facing the second draw cable pulley, so as to (i) receive a second power cable of the bow in a first circumferential power cable groove of the second dual-groove power module, and (ii) take up the second power cable into the first power cable groove when the bow is drawn and the second draw cable pulley rotates about the second pulley assembly axis;

(e') the second dual-groove power module is structurally arranged, when attached to the second draw cable pulley in the second second power module orientation with the second face facing the second draw cable pulley, so as to (i) receive the second power cable of the bow in a second circumferential power cable groove of the second dual-groove power module, and (ii) take up the second power cable into the second power cable groove when the bow is drawn and the second draw cable pulley rotates about the second pulley assembly axis; and (f') for each one of the one or more second power module positions, the first and second second power module orientations result in corresponding draw force curves of the bow that differ substantially from each other.

11. The pulley assemblies of claim 10 wherein, for each one of the one or more second power module positions, the first and second power module orientations result in corresponding draw lengths that do not differ substantially from each other, corresponding draw weights that do not differ substantially from each other, and corresponding stored energies of the drawn bow that differ substantially from each other.

12. A method for adjusting the pulley assembly of claim 10, the method comprising:

(A) removing the dual-groove power module from one of the one or more power module positions and one of the first or second power module orientations on the draw cable pulley;

(A') removing the second dual-groove power module from one of the one or more second power module positions and one of the first or second second power module orientations on the second draw cable pulley;

(B) attaching the dual-groove power module to the second draw cable pulley in the same one of the one or more second power module positions and in the same one of the first or second power module orientations; and (B') attaching the second dual-groove power module to the draw cable pulley in the same one of the one or more power module positions and in the same one of the first or second second power module orientations, (C) thereby altering one or more of stored energy of the drawn bow, draw length of the bow, or draw weight of the bow.

13. A compound archery bow, comprising:

(a) a central riser;

(b) first and second bow limbs secured to opposing ends of the riser;

(c) a first pulley assembly rotatably mounted on the first bow limb;

(d) either an idler wheel or a second pulley assembly rotatably mounted on the second bow limb;

(e) a draw cable; and (f) a power cable, wherein:

(g) the first pulley assembly comprises a draw cable pulley and a dual-groove power module substantially rigidly attached to the draw cable pulley;

(h) the draw cable pulley is structurally arranged so as to (i) define a first pulley assembly transverse rotation axis, (ii) be mounted on the first limb of the bow to rotate about the first pulley assembly axis, (iii) receive a first end of the draw cable in a circumferential draw cable groove of the draw cable pulley, and (iv) let out the first end of the draw cable from the draw cable groove when the bow is drawn and the draw cable pulley rotates about the first pulley assembly axis;

(i) one or both of the draw cable pulley and the dual-groove power module are structurally arranged so as to enable substantially rigid, removable attachment of the dual-groove power module to the draw cable pulley in any one of one or more power module positions and, for each power module position, in any one of first or second power module orientations;

(j) the dual-groove power module has opposite first and second faces, a first circumferential power cable groove adjacent the first face, and a second circumferential power cable groove adjacent the second face;

(k) the dual-groove power module is structurally arranged, when attached to the draw cable pulley in the first power module orientation with the first face facing the draw cable pulley, so as to (i) receive the power cable in a first circumferential power cable groove of the dual-groove power module, and (ii) take up the power cable into the first power cable groove when the bow is drawn and the draw cable pulley rotates about the first pulley assembly axis;

(l) the dual-groove power module is structurally arranged, when attached to the draw cable pulley in the second power module orientation with the second face facing the draw cable pulley, so as to (i) receive the power cable of the bow in a second circumferential power cable groove of the dual-groove power module, and (ii) take up the power cable into the second power cable groove when the bow is drawn and the draw cable pulley rotates about the first pulley assembly axis; and (m) for each one of the one or more power module positions, the first and second power module orientations result in corresponding draw force curves of the bow that differ substantially from each other.

14. The compound archery bow of claim 13 wherein, for each one of the one or more power module positions, the first and second power module orientations result in corresponding draw lengths that do not differ substantially from each other, corresponding draw weights that do not differ substantially from each other, and corresponding stored energies of the drawn bow that differ substantially from each other.

15. A method for adjusting the compound archery bow of claim 13, the method comprising:

(A) removing the dual-groove power module from one of the one or more power module positions and one of the first or second power module orientations on the draw cable pulley; and (B) reattaching the dual-groove power module to the draw cable pulley in the same one of the one or more power module positions and in a different one of the two power module orientations, (C) thereby altering one or more of stored energy of the drawn bow, draw length of the bow, or draw weight of the bow.

16. The compound archery bow of claim 13 wherein:

(b') one or both of the draw cable pulley and the dual-groove power module are structurally arranged so as to enable substantially rigid, removable attachment of the dual-groove power module to the draw cable pulley in any one of multiple power module positions;

(c') the dual-groove power module is structurally arranged, when attached to the draw cable pulley in the first power module orientation, so that each one of the multiple power module positions results in a corresponding draw force curve of the bow that differs from a draw force curve corresponding to at least one other of the multiple power module positions; and (d') the dual-groove power module is structurally arranged, when attached to the draw cable pulley in the second power module orientation, so that each one of the multiple power module positions results in a corresponding draw force curve of the bow that differs from a draw force curve corresponding to at least one other of the multiple power module positions.

17. A method for adjusting the compound archery bow of claim 16, the method comprising:

(A) removing the dual-groove power module from one of the multiple power module positions and one of the first or second power module orientations on the draw cable pulley; and (B) reattaching the dual-groove power module to the draw cable pulley in a different one of the multiple power module positions and in the same one of the first or second power module orientations, (C) thereby altering one or more of stored energy of the drawn bow, draw length of the bow, or draw weight of the bow.

18. The compound archery bow of claim 16 wherein (i) the first pulley assembly further comprises a mounting member, (i) one or both of the mounting member and the draw cable pulley are structurally arranged so as to enable substantially rigid, removable attachment of the mounting member to the draw cable pulley in any one of multiple mounting member positions, (ii) one or both of the mounting member and the dual-groove power module are structurally arranged so as to enable substantially rigid, removable attachment of the dual-groove power module to the mounting member in any one of the first or second power module orientations and in any one of the one or more power module positions, and (iii) attachment of the dual-groove power module to the mounting member and attachment of the mounting member to the power cable pulley provide the substantially rigid, removable attachment of the dual-groove power module to the draw cable pulley.

19. The compound archery bow of claim 13 further comprising a rotation stop substantially rigidly attached to the draw cable pulley, wherein one or both of the draw cable pulley and the rotation stop are structurally arranged so as to enable substantially rigid attachment of the rotation stop to the draw cable pulley in any one of multiple rotation stop positions, each rotation stop position corresponding to a draw length resulting from the first or second power module orientation and one of the one or more power module positions.

20. A method for adjusting the compound archery bow of claim 19, the method comprising:

(A) removing the dual-groove power module from one of the multiple power module positions and one of the first or second power module orientations on the draw cable pulley;

(B) reattaching the dual-groove power module to the draw cable pulley in a different one of the multiple power module positions or in a different one of the first or second power module orientations, so as to alter the draw length of the bow; and (C) moving the rotation stop from a first one of the multiple rotation stop positions and substantially rigidly attaching the rotation stop to the draw cable pulley in a second, different one of the multiple rotation stop positions that corresponds to the altered draw length of the bow.

21. The compound archery bow of claim 13 further comprising the second pulley assembly, wherein the second pulley assembly includes a power cable let-out pulley that is structurally arranged so as to (i) receive the power cable in a circumferential power cable groove of the power cable let-out pulley, and (ii) let out the power cable from the power cable groove when the bow is drawn and the second pulley assembly rotates about a second pulley assembly axis.

22. The compound archery bow of claim 13 further comprising the idler wheel, wherein:

(n) the first pulley assembly further comprises a draw cable let-out pulley substantially rigidly attached to the first draw cable pulley or the dual-groove power module; and (o) the draw cable let-out pulley is structurally arranged so as to (i) receive a second end of the draw cable in a circumferential draw cable groove of the draw cable let-out pulley, and (ii) let out the second end of the draw cable from the draw cable groove, with the draw cable passing around the idler wheel, when the bow is drawn and the draw cable pulley rotates about the first pulley assembly axis.

23. The compound archery bow of claim 13 further comprising the second pulley assembly and a coupling cable, wherein:

(n) the first pulley assembly further comprises a coupling cable let-out pulley substantially rigidly attached to the draw cable pulley or the dual-groove power module;

(o) the second pulley assembly comprises a second draw cable pulley and a coupling cable take-up pulley;

(p) the second draw cable pulley is structurally arranged so as to (i) receive a second end of the draw cable in a circumferential draw cable groove of the second draw cable pulley, and (ii) let out the second end of the draw cable from the draw cable groove when the bow is drawn and the second pulley assembly rotates about the second pulley assembly axis;

(q) the coupling cable take-up pulley is structurally arranged so as to (i) receive a first end of the coupling cable in a circumferential coupling cable groove of the coupling cable take-up pulley, and (ii) take up the first end of the coupling cable into the coupling cable groove when the bow is drawn and the second pulley assembly rotates about the second pulley assembly axis; and (r) the coupling cable let-out pulley is structurally arranged so as to (i) receive a second end of the coupling cable in a circumferential coupling cable groove of the coupling cable let-out pulley, and (ii) let out the second end of the coupling cable from the coupling cable groove when the bow is drawn and the first pulley assembly rotates about the first pulley assembly axis.

24. A compound archery bow, comprising:

(a) a central riser;

(b) first and second bow limbs secured to opposing ends of the riser;

(c) a first draw cable pulley rotatably mounted on the first bow limb;

(d) a second draw cable pulley that is a mirror image of the first draw cable pulley and is rotatably mounted on the second bow limb;

(e) first and second dual-groove power modules that are mirror images of each other; and (f) a draw cable and two power cables, wherein:

(g) each one of the first and second draw cable pulleys is structurally arranged so as to (i) define a corresponding pulley assembly transverse rotation axis, (ii) be mounted on the corresponding limb of the bow to rotate about the corresponding pulley assembly axis, (iii) receive a corresponding end of the draw cable in a corresponding circumferential draw cable groove, and (iv) let out the corresponding end of the draw cable from the corresponding draw cable groove when the bow is drawn and the first and second draw cable pulleys rotate about the corresponding pulley assembly axes;

(h) the first and second draw cable pulleys, the first and second dual-groove power modules, or both are structurally arranged so as to enable (i) substantially rigid, removable attachment of one of the first or second dual-groove power modules to the first draw cable pulley in any one of one or more first pulley assembly power module positions and, for each first pulley assembly power module position, in any one of first or second first pulley assembly power module orientations, and (ii) substantially rigid, removable attachment of the other of the first or second power modules to the second draw cable pulley in a corresponding one of one or more second pulley assembly power module positions and, for each second pulley assembly power module position, in any one of first or second second pulley assembly power module orientations;

(i) each one of the first and second dual-groove power modules has opposite first and second faces, a first circumferential power cable groove adjacent the first face, and a second circumferential power cable groove adjacent the second face;

(j) each one of the first and second power modules is structurally arranged, when substantially rigidly attached to a corresponding one of the first or second draw cable pulleys with the corresponding first face facing the corresponding draw cable pulley, so as to (i) receive a first end of a corresponding one of the power cables in the first circumferential power cable groove of that power module, and (ii) take up the corresponding power cable into the corresponding first power cable groove when the bow is drawn and the first and second draw cable pulleys rotate about the corresponding pulley assembly axes; and (k) each one of the first and second power modules is structurally arranged, when substantially rigidly attached to a corresponding one of the first or second draw cable pulleys with the corresponding second face facing the corresponding draw cable pulley, so as to (i) receive a first end a corresponding one of the power cables in the second circumferential power cable groove of that power module, and (ii) take up the corresponding power cable into the corresponding second power cable groove when the bow is drawn and the first and second draw cable pulleys rotate about the corresponding pulley assembly axes.

25. The compound archery bow of claim 24 wherein, for each one of the one or more first and second pulley assembly power module positions, the first and second pulley assembly first and second power module orientations result in corresponding draw lengths that do not differ substantially from each other, corresponding draw weights that do not differ substantially from each other, and corresponding stored energies of the drawn bow that differ substantially from each other.

26. The compound archery bow of claim 24 wherein:

(n) the first pulley assembly further comprises a first power cable let-out pulley substantially rigidly attached to the draw cable pulley or the dual-groove power module;

(o) the first power cable let-out pulley is structurally arranged so as to (i) receive a second end of the second power cable of the bow in a circumferential power cable groove of the first power cable let-out pulley, and (ii) let out the second power cable from the power cable groove when the bow is drawn and the draw cable pulley rotates about the first pulley assembly axis;

(p) the second pulley assembly further comprises a second power cable let-out pulley substantially rigidly attached to the second draw cable pulley or the second dual-groove power module; and (q) the second power cable let-out pulley is structurally arranged so as to (i) receive a second end of the first power cable of the bow in a circumferential power cable groove of the second power cable let-out pulley, and (ii) let out the first power cable from the power cable groove when the bow is drawn and the second draw cable pulley rotates about the second pulley assembly axis.

27. The compound archery bow of claim 24 wherein:

(n) each one of the first and second power modules is structurally arranged, when substantially rigidly attached to a corresponding one of the first or second draw cable pulleys with the corresponding first face facing the corresponding draw cable pulley, so as to (i) receive a second end of a corresponding one of the power cables in the second circumferential power cable groove of that power module, and (ii) let out the corresponding power cable from the corresponding second power cable groove when the bow is drawn and the first and second draw cable pulleys rotate about the corresponding pulley assembly axes; and (o) each one of the first and second power modules is structurally arranged, when substantially rigidly attached to a corresponding one of the first or second draw cable pulleys with the corresponding second face facing the corresponding draw cable pulley, so as to (i) receive a second end of a corresponding one of the power cables in the first circumferential power cable groove of that power module, and (ii) let out the corresponding power cable from the corresponding first power cable groove when the bow is drawn and the first and second draw cable pulleys rotate about the corresponding pulley assembly axes.

28. A method for adjusting the compound archery bow of claim 24, the method comprising:

(A) removing the first dual-groove power module from one of the one or more first pulley assembly power module positions and one of the first or second first pulley assembly power module orientations on the first draw cable pulley;

(B) removing the second dual-groove power module from a corresponding one of the one or more second pulley assembly power module positions and a corresponding one of the first or second second power module orientations on the second draw cable pulley;

(C) attaching the first dual-groove power module to the first draw cable pulley in a different one of the one or more first pulley assembly power module positions or a different one of the first or second first pulley assembly power module orientations on the first draw cable pulley; and (D) attaching the second dual-groove power module to the second draw cable pulley in a corresponding different one of the one or more second pulley assembly power module positions or a corresponding different one of the first or second second pulley assembly power module orientations on the second draw cable pulley, (E) thereby altering one or more of stored energy of the drawn bow, draw length of the bow, or draw weight of the bow.

29. A method for adjusting the compound archery bow of claim 24, the method comprising:

(A) removing the first dual-groove power module from one of the one or more first pulley assembly power module positions and one of the first or second first pulley assembly power module orientations on the first draw cable pulley;

(B) removing the second dual-groove power module from a corresponding one of the one or more second pulley assembly power module positions and a corresponding one of the first or second second pulley assembly power module orientations on the second draw cable pulley;

(C) attaching the first dual-groove power module to the first draw cable pulley in a different one of the one or more first pulley assembly power module positions and the same one of the first or second first pulley assembly power module orientations on the first draw cable pulley; and (D) attaching the second dual-groove power module to the second draw cable pulley in a corresponding different one of the one or more second pulley assembly power module positions and the same one of the first or second second pulley assembly power module orientations on the second draw cable pulley, (E) thereby altering one or more of stored energy of the drawn bow, draw length of the bow, or draw weight of the bow.

30. A method for adjusting the compound archery bow of claim 24, the method comprising:

(A) removing the first dual-groove power module from one of the one or more first pulley assembly power module positions and one of the first or second first pulley assembly power module orientations on the first draw cable pulley;

(B) removing the second dual-groove power module from a corresponding one of the one or more second pulley assembly power module positions and a corresponding one of the first or second second pulley assembly power module orientations on the second draw cable pulley;

(C) attaching the first dual-groove power module to the first draw cable pulley in the same one of the one or more first pulley assembly power module positions and a different one of the first or second first pulley assembly power module orientations on the first draw cable pulley; and (D) attaching the second dual-groove power module to the second draw cable pulley in the same one of the one or more second pulley assembly power module positions and a different one of the first or second second pulley assembly power module orientations on the second draw cable pulley, (E) thereby altering one or more of stored energy of the drawn bow, draw length of the bow, or draw weight of the bow.

31. A method for adjusting the compound archery bow of claim 24, the method comprising:

(A) removing the first dual-groove power module from one of the one or more first pulley assembly power module positions and one of the first or second first pulley assembly power module orientations on the first draw cable pulley;

(B) removing the second dual-groove power module from a corresponding one of the one or more second pulley assembly power module positions and a corresponding one of the first or second second pulley assembly power module orientations on the second draw cable pulley;

(C) attaching the second dual-groove power module to the first draw cable pulley in one of the one or more first pulley assembly power module positions and one of the first or second first pulley assembly power module orientations on the first draw cable pulley; and (D) attaching the first dual-groove power module to the second draw cable pulley in a corresponding one of the one or more second pulley assembly power module positions and a corresponding one of the first or second second pulley assembly power module orientations on the second draw cable pulley, (E) thereby altering one or more of stored energy of the drawn bow, draw length of the bow, or draw weight of the bow.

32. A method for adjusting the compound archery bow of claim 24, the method comprising:

(A) removing the first dual-groove power module from one of the one or more first pulley assembly power module positions and one of the first or second first pulley assembly power module orientations on the first draw cable pulley;

(B) removing the second dual-groove power module from a corresponding one of the one or more second pulley assembly power module positions and a corresponding one of the first or second second pulley assembly power module orientations on the second draw cable pulley;

(C) attaching the second dual-groove power module to the first draw cable pulley in the same one of the one or more first pulley assembly power module positions and the same one of the first or second first pulley assembly power module orientations on the first draw cable pulley; and (D) attaching the first dual-groove power module to the second draw cable pulley in the corresponding same one of the one or more second pulley assembly power module positions and the corresponding same one of the first or second second pulley assembly power module orientations on the second draw cable pulley, (E) thereby altering one or more of stored energy of the drawn bow, draw length of the bow, or draw weight of the bow.

33. A method for adjusting the compound archery bow of claim 24, the method comprising:

(A) removing the first dual-groove power module from one of the one or more first pulley assembly power module positions and one of the first or second first pulley assembly power module orientations on the first draw cable pulley;

(B) removing the second dual-groove power module from a corresponding one of the one or more second pulley assembly power module positions and a corresponding one of the first or second second pulley assembly power module orientations on the second draw cable pulley;

(C) attaching the second dual-groove power module to the first draw cable pulley in the same one of the one or more first pulley assembly power module positions and a different one of the first or second first pulley assembly power module orientations on the first draw cable pulley; and (D) attaching the first dual-groove power module to the second draw cable pulley in the corresponding same one of the one or more second pulley assembly power module positions and a corresponding different one of the first or second second pulley assembly power module orientations on the second draw cable pulley, (E) thereby altering one or more of stored energy of the drawn bow, draw length of the bow, or draw weight of the bow.

* * * * *